US011114033B2

(12) United States Patent
Park et al.

(10) Patent No.: US 11,114,033 B2
(45) Date of Patent: Sep. 7, 2021

(54) PIXEL AND DISPLAY DEVICE INCLUDING THE SAME

(71) Applicant: SAMSUNG DISPLAY CO., LTD., Yongin-si (KR)

(72) Inventors: Jun Hyun Park, Yongin-si (KR); Bon Yong Koo, Yongin-si (KR); Yu Jin Lee, Yongin-si (KR); Kyung Hoon Chung, Yongin-si (KR); Chong Chul Chai, Yongin-si (KR)

(73) Assignee: SAMSUNG DISPLAY CO., LTD., Yongin-si (KR)

( * ) Notice: Subject to any disclaimer, the term of this patent is extended or adjusted under 35 U.S.C. 154(b) by 0 days.

(21) Appl. No.: 16/855,038

(22) Filed: Apr. 22, 2020

(65) Prior Publication Data

US 2021/0027702 A1 Jan. 28, 2021

(30) Foreign Application Priority Data

Jul. 22, 2019 (KR) ..... 10-2019-0088450

(51) Int. Cl.

| | |
|---|---|
| ***G09G 3/325*** | (2016.01) |
| ***G09G 3/36*** | (2006.01) |
| ***G09G 3/3291*** | (2016.01) |
| ***G09G 3/3266*** | (2016.01) |

(52) U.S. Cl.

CPC ..... *G09G 3/325* (2013.01); *G09G 3/3266* (2013.01); *G09G 3/3291* (2013.01); *G09G 3/3659* (2013.01)

(58) Field of Classification Search

CPC .... G09G 3/325; G09G 3/3266; G09G 3/3291; G09G 3/3659

See application file for complete search history.

(56) References Cited

U.S. PATENT DOCUMENTS

| | | | |
|---|---|---|---|
| 9,251,751 | B2 | 2/2016 | Shin et al. |
| 10,056,034 | B2 | 8/2018 | Zhu et al. |
| 10,210,811 | B2 | 2/2019 | Lee |

(Continued)

FOREIGN PATENT DOCUMENTS

| | | |
|---|---|---|
| KR | 10-2013-0075429 | 7/2013 |
| KR | 10-2015-0016010 | 2/2015 |

(Continued)

*Primary Examiner* — Dmitriy Bolotin

(74) *Attorney, Agent, or Firm* — F. Chau & Associates, LLC

(57) ABSTRACT

A pixel including: a light emitter; a first transistor including first and second electrodes respectively connected to power and the light emitter, the first transistor controlling driving current; a first capacitor between a second and third node; a second transistor between the third node and data line and turned on by a scan signal; a third transistor between a first and second node, and turned on by a control signal; a fourth transistor between power and the third node, and turned on by a emission control signal; a fifth transistor between power and the first electrode, and turned on by the emission control signal; a sixth transistor between the second node and the light emitter, and turned on by another emission control signal; and a second capacitor between power and the first node, wherein the fourth, fifth and sixth transistors turn-on/off at least four times in a non-emission period.

21 Claims, 13 Drawing Sheets

(56) References Cited

U.S. PATENT DOCUMENTS

| | | | | |
|---|---|---|---|---|
| 2013/0127924 | A1* | 5/2013 | Lee | G09G 3/32<br>345/690 |
| 2017/0092191 | A1* | 3/2017 | An | G09G 3/3233 |
| 2017/0124941 | A1* | 5/2017 | Na | G09G 3/3233 |
| 2018/0374419 | A1 | 12/2018 | Chen et al. | |
| 2019/0304365 | A1* | 10/2019 | Hyun | G09G 3/3233 |
| 2020/0327861 | A1* | 10/2020 | Kim | G09G 3/3233 |
| 2020/0403131 | A1* | 12/2020 | Kim | H01L 33/14 |
| 2021/0027701 | A1* | 1/2021 | Park | G09G 3/3659 |

FOREIGN PATENT DOCUMENTS

| | | |
|---|---|---|
| KR | 10-2015-0142143 | 12/2015 |
| KR | 10-2021-0011553 | 2/2021 |

* cited by examiner

PIXEL AND DISPLAY DEVICE INCLUDING THE SAME

CROSS-REFERENCE TO RELATED APPLICATION

The present application claims priority under 35 U.S.C. § 119 to Korean patent application number 10-2019-0088450 filed on Jul. 22, 2019 in the Korean Intellectual Property Office, the disclosure of which is incorporated by reference herein in its entirety.

TECHNICAL FIELD

Exemplary embodiments of the present invention relate to a display device, and more particularly, to a pixel and a display device including the pixel.

DESCRIPTION OF RELATED ART

A display device is an output device for the presentation of information in visual form. In general, a display device includes a plurality of pixels. Each of the pixels may emit light based on a data signal supplied to a driving transistor.

A method for driving a display device using a low frequency (e.g., 1 Hz driving) may be used to minimize power consumption. However, when driving a display device at a to frequency, a displayed image may flicker. To prevent image flicker, a technique of minimizing leakage of a data signal stored in each pixel may be employed.

In addition to low frequency driving, a display device may be driven at a high frequency (e.g., 120 Hz) to realize a high resolution or three-dimensional image. However, to secure image quality having a predetermined level or more under high speed driving conditions, a sufficient amount of time should be given to compensate for a threshold voltage of the driving transistor.

SUMMARY

An exemplary embodiment of the present invention may provide a pixel including: a light emitting element; a first transistor including a first electrode electrically coupled to a first power supply, and a second electrode electrically coupled to the light emitting element, the first transistor configured to control a driving current; a first capacitor coupled between a second node and a third node, wherein the second node is connected to the second electrode of the first transistor; a second transistor coupled between the third node and a data line and configured to be turned on by a scan signal; a third transistor coupled between a first node and the second node, and configured to be turned on by a control signal, wherein the first node is connected to a gate electrode of the first transistor; a fourth transistor coupled between the first power supply and the third node, and configured to be turned on by a first emission control signal; a fifth transistor coupled between the first power supply and the first electrode of the first transistor, and configured to be turned on by the first emission control signal; a sixth transistor coupled between the second node and the light emitting element, and configured to be turned on by a second emission control signal; and a second capacitor coupled between the first power supply and the first node, wherein, during a non-emission period in a frame, each of the fourth, fifth and sixth transistors repeatedly performs a turn-on operation and a turn-off operation at least four times in response to the first emission control signal or the second emission control signal.

During the non-emission period, each of the first emission control signal and the second emission control signal may include a plurality of gate-on periods and a plurality of gate-off periods.

The non-emission period may include an on-bias period in which each of the second emission control signal and the control signal has a gate-off level and the first emission control signal has a gate-on level.

During the on-bias period, the third and sixth transistors may be turned off, and the fourth and fifth transistors may be turned on.

When the third, fourth and fifth transistors are turned on, the second and sixth transistors may be turned off.

The pixel may further include: a seventh transistor coupled between the light emitting element and an initialization power supply and configured to be turned on by the control signal.

The non-emission period may include a first initialization period in which the initialization power supply is supplied to a fourth node between the light emitting element and the seventh transistor, a second initialization period in which the initialization power supply is supplied to the fourth node and the first node, an on-bias period in which the first transistor has an on-bias state, a compensation period in which the first transistor is diode-connected based on a voltage of the first power supply, and a write period in which the second transistor is turned on so that a data signal is supplied through the data line.

In response to the control signal, the third transistor may be turned on during the second initialization period, the compensation period, and the write period, and may be turned off during the on-bias period.

During the non-emission period, at least one of the second initialization period, the on-bias period, and the compensation period may be repeated at least two times.

During each of the first initialization period, the second initialization period, the on-bias period, and the compensation period, a switching operation of each of the fourth and fifth transistors may be performed in reverse to a switching operation of the sixth transistor.

During the second initialization period, the third, sixth, and seventh transistors may be turned on and the fourth and fifth transistors may be turned off, so that the first transistor has an off-bias state.

During the compensation period, the third, fourth and fifth transistors may be turned on and the second and sixth transistors may be turned off and during the write period, the second and third transistors may be turned on, and the fourth, fifth and sixth transistors may be turned off.

A length of the compensation period may be greater than a length of the write period.

During the write period, a gate-off period of the control signal may overlap with a portion of a gate-on period of the scan signal, and while the second transistor remains turned on during the write period, the third transistor may be turned off.

The emission control signal may be obtained by shifting the second emission control signal by k horizontal cycles, wherein k is an integral number greater than or equal to 3.

An exemplary embodiment of the present invention may provide a display device including: a display panel including a plurality of pixels; a first scan driver configured to supply a scan signal to the pixels through a plurality of scan lines; a second scan driver configured to supply a control signal to the pixels through a plurality of control lines; an emission driver configured to supply an emission control signal to the pixels through a plurality of emission control lines; and a data driver configured to supply a data voltage to the display panel through a plurality of data lines, wherein each of the pixels includes: a light emitting element; a first transistor including a first electrode electrically coupled to a first power supply, and a second electrode electrically coupled to the light emitting element, the first transistor configured to control a driving current; a first capacitor coupled between a second node and a third node, wherein the second node is connected to the second electrode of the first transistor; a second transistor coupled between the third node and a corresponding one of the data lines and configured to be turned on by the scan signal; a third transistor coupled between a first node and the second node, and configured to be turned on by the control signal, wherein the first node is connected to a gate electrode of the first transistor; a fourth transistor coupled between the first power supply and the third node, and configured to be turned on by the emission control signal; a fifth transistor coupled between the first power supply and the first electrode of the first transistor, and configured to be turned on by the emission control signal; a sixth transistor coupled between the second node and the light emitting element, and configured to be turned on by a preceding emission control signal; a seventh transistor coupled between the light emitting element and an initialization power supply, and configured to be turned on by the control signal; and a second capacitor coupled between the first power supply and the first node, wherein, during a non-emission period in a frame, each of the fourth, fifth and sixth transistors repeatedly performs a turn-on operation and a turn-off operation at least four times.

The non-emission period may include an on-bias period in which each of the preceding emission control signal and the control signal has a gate-off level and the emission control signal has a gate-on level, and during the on-bias period, the third and sixth transistors may be turned off, and the fourth and fifth transistors may be turned on.

The emission driver may simultaneously supply the emission control signal to the fourth and fifth transistors of an n-th pixel disposed on an n-th pixel row and to the fourth and fifth transistors of an n+1-th pixel disposed on n+1-th pixel row.

The second scan driver may simultaneously supply the control signal to the third and seventh transistors of the n-th pixel and to the third and seventh transistors of the n+1-th pixel.

The non-emission period may include an off-bias period in which each of the preceding emission control signal and the control signal has a gate-on level and the emission control signal has a gate-off level, and during the off-bias period, the third and sixth transistors my be turned on, the fourth and fifth transistors may be turned on, and the first transistor may have an off-bias state.

An exemplary embodiment of the present invention may provide a pixel including: a light emitting element; a first transistor including a first electrode electrically coupled to a first power supply, and a second electrode electrically coupled to the light emitting element, the first transistor configured to control a driving current; a first capacitor coupled to the second electrode of the first transistor; a second transistor coupled between a data line and the first capacitor and configured to be turned on by a scan signal; a third transistor coupled between a gate electrode of the first transistor and the second electrode of the first transistor; a fourth transistor coupled between the first power supply and the second capacitor, and configured to be turned on by a first emission control signal; a fifth transistor coupled between the first power supply and the first electrode of the first transistor, and configured to be turned on by the first emission control signal; a sixth transistor coupled between the second electrode of the first transistor and the light emitting element, and configured to be turned on by a second emission control signal; and a second capacitor coupled, between the first power supply and the gate electrode of the first transistor, wherein, during a non-emission period in a frame, each of the fourth, fifth and sixth transistors repeatedly performs a turn-on operation and a turn-off operation at least four times in response to the first emission control signal or the second emission control signal.

DETAILED DESCRIPTION OF THE EMBODIMENTS

Figure 1:
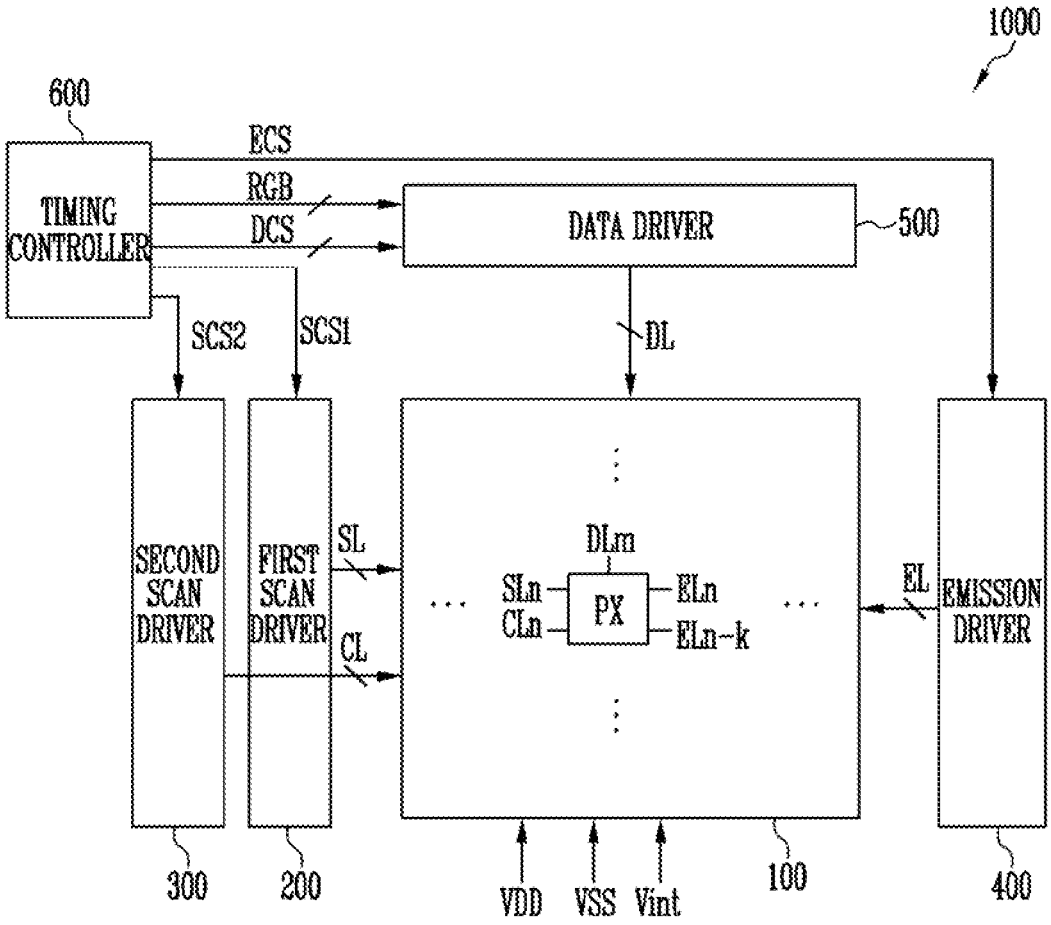
FIG. 1 is a block diagram illustrating a display device in accordance with an exemplary embodiment of the present invention.

Exemplary embodiments of the present invention will hereinafter be described in detail with reference to the accompanying drawings. In the drawings, the same or similar elements may be denoted by the same reference numerals, and thus, a repetitive description of the same or similar elements may be omitted.

FIG. 1 is a block diagram illustrating a display device 1000 in accordance with exemplary embodiments of the present invention.

Referring to FIG. 1, the display device 1000 may include a display panel 100, a first scan driver 200, a second scan driver 300 an emission driver 400, a data driver 500, and a timing controller 600.

In an exemplary embodiment of the present invention, the display device 1000 may further include a power supply configured to control a voltage of a first power supply VDD, a voltage of a second power supply VSS, and a voltage of a third power supply (or an initialization power supply Vint) applied to the display panel 100. The power supply may apply a low power supply and a high power supply to the first scan driver 200, the second scan driver 300, and/or the emission driver 400. The low power supply and the high power supply may determine whether the level of a scan signal, a control signal, and/or an emission control signal is a gate-on level or gate-off level. The low power supply may have a voltage level lower than that of the high power supply. However, this is merely exemplary. At least one of the first power supply VDD, the second power supply VSS, the initialization power supply Vint, the low power supply, and the high power supply may be supplied from the timing controller 600 or the data driver 500.

In an exemplary embodiment of the present invention, the first power supply VDD and the second power supply VSS may generate voltages for driving a light emitting element. In an exemplary embodiment of the present invention, the voltage of the second power supply VSS may be lower than that of the first power supply VDD. For example, the voltage of the first power supply VDD may be a positive voltage, and the voltage of the second power supply VSS may be a negative voltage.

The initialization power supply Vint may be a power supply for initializing the pixel PX. For example, a driving transistor and/or a light emitting element included the pixel PX may be initialized by the voltage of the initialization power supply Vint. The initialization power supply Vint may be a negative voltage.

The display panel 100 may include a plurality of scan lines SL, a plurality of control lines CL, a plurality of emission control lines EL, and a plurality of data lines DL. The display panel 100 may also include a plurality of pixels PX coupled to the scan lines SL the control lines CL, the emission control lines EL, and the data lines DL. In an exemplary embodiment of the present invention, a pixel PX disposed on an n-th row and an m-th column (here, each of n and m is a natural number) may be coupled to a scan line SLn corresponding to an n-th pixel row, a control line CLn corresponding to the n-th pixel row, an emission control line ELn corresponding to the n-th pixel row, an emission control line ELn−k corresponding to an n−k-th pixel row (k is a natural number equal to or less than 10), and a data line DLm corresponding to an m-th pixel column.

The timing controller 600 may generate a first driving control signal SCS1, a second driving control signal SCS2, a third driving control signal ECS, and a fourth driving control signal DCS in response to synchronization signals supplied from an external device. The first driving control signal SCS1 may be supplied to the first scan driver 200. The second driving control signal SCS2 may be supplied to the second scan driver 300. The third driving control signal ECS may be supplied to the emission driver 400. The fourth driving control signal DCS may be supplied to the data driver 500. The timing controller 600 may rearrange input image data supplied from an external device to generate image data RGB and then supply the image data RGB to the data driver 500.

The first driving control signal SCS1 may include a first scan start pulse and dock signals. The first scan start pulse may control a first timing of a scan signal. The clock signals of the first driving control signal SCS1 may be used to shift the first scan start pulse.

The second driving control signal SCS2 may include a second scan start pulse (e.g., a start pulse of a control signal) and clock signals. The second scan start pulse may control a first timing of a control signal. The clock signals of the second driving control signal SCS2 may be used to shift the first scan start pulse. In an exemplary embodiment of the present invention, the control signal may be a scan signal (e.g., a second scan signal) different from a scan signal (e.g., a first scan signal) output from the first scan driver 200.

The third driving control signal ECS may include an emission control start pulse and clock signals. The emission control start pulse may control a first timing of a scan signal. The clock signals of the third driving control signal ECS may be used to shift the emission control start pulse.

The fourth driving control signal DCS may include a source start pulse and clock signals. The source start pulse may control a time at which data sampling starts. The clock signals of the fourth driving control signal DCS may be used to control a sampling operation.

The first scan driver 200 may receive a first driving control signal SCS1 from the timing controller 600 and apply scan signals to the scan lines SL based on the first driving control signal SCS1. For example, the first scan driver 200 may sequentially supply scan signals (e.g., first scan signals) to scan lines SL (e.g., first scan lines) at an interval of one horizontal cycle (1H). When the scan signals are sequentially supplied, the pixels PX may be selected on a horizontal line basis (or a pixel row basis) and data signals may be supplied to the pixels PX. The scan signals are used to write data.

Each scan signal may be set to a gate-on level (e.g., a low voltage). A transistor that is included in each pixel PX and receives a scan signal may be turned-on when the scan signal is supplied thereto.

In an exemplary embodiment of the present invention, the first scan driver 200 may supply a scan signal to each of the scan lines SL once during one frame period.

The second scan driver 300 may receive a second driving control signal SCS2 from the timing controller 600 and supply control signals (e.g., second scan signals) to control lines CL (e.g., second scan lines) based on the second driving control signal SCS2. For example, the second scan driver 300 may sequentially supply control signals to the control lines CL at an interval (e.g., corresponding to two horizontal cycles) longer than the one horizontal cycle (1H). When the control signals are supplied, the pixels PX each may perform a threshold voltage compensation and/or initialization operation. For example, the threshold voltage compensation operation may be performed to compensate for a threshold voltage of a driving transistor of the pixel PX.

In an exemplary embodiment of the present invention, the second scan driver 300 may simultaneously supply a control signal to consecutive pixel rows. For example, the second scan driver 300 may simultaneously supply the same control signal to an n-th control line CLn and an n+1-th control line CLn+1. In other words, the second scan driver 300 may shift and supply a control signal to each of two or more control lines, and consecutive pixel rows corresponding to the control lines may share the same control signal.

In this case, the number of stages included in the second scan driver 300 may be less than the number of stages included in the first scan driver 200 to shift and output the control signal.

The control signal may be set to a gate-on level (e.g., a low voltage). A transistor that is included in each pixel PX and receives a control signal may be turned-on when the control signal is supplied thereto.

The control signal may be supplied for initialization and/or threshold voltage compensation of the pixel PX.

The light emitting driver 400 may receive a third driving control signal ECS from the timing controller 600, and supply emission control signals to the emission control lines EL based on the third driving control signal ECS. For example, the light emitting driver 400 may sequentially supply emission control signals to the emission control lines EL.

In an exemplary embodiment of the present invention, the emission driver 400 may simultaneously supply emission control signals to consecutive pixel rows. For example, the emission driver 400 may simultaneously supply the same control signal to an n-th emission control line ELn and an n+1-th emission control line ELn+1. In other words, the emission driver 400 may shift and supply an emission control signal to each of two or more emission control lines, and consecutive pixel rows corresponding to the emission control lines may share the same emission control signal.

In this case, the number of stages included in the emission driver 400 may be less than the number of stages included in the first scan driver 200 to shift and output the emission control signal.

The emission control signal may be set to be a gate-on level (e.g., a low voltage). A transistor that is included in each pixel PX and receives an emission control signal may be turned on when the emission control signal is supplied thereto, and may be turned off in the other cases. For example, the transistor may be turned off when the emission control signal is not supplied thereto.

The emission control signal is used to control the emission time of the pixels PX. In an exemplary embodiment of the present invention, the emission control signal may have a width greater than that of the scan signal.

In an exemplary embodiment of the present invention, during one frame period, the emission control signal may have a plurality of gate-off level (e.g., high voltage) periods. For example, the emission control signal may include a plurality of gate-on periods and a plurality of gate-off periods for a bias state control, initialization, and threshold voltage compensation of the driving transistor.

The first scan driver 200, the second scan driver 300, and the emission driver 400 each may be mounted on the substrate through a thin-film process. The first scan driver 200 and the second scan driver 300 may be respectively disposed on opposite sides of the display panel 100. The emission driver 400 may also be disposed on the opposite sides of the display panel 100. However, the present invention is not limited thereto and the first scan driver 200 and the second scan driver 300 may be disposed on the same side of the display panel 100 as shown in FIG. 1.

The data driver 500 may receive a fourth driving control signal DCS and image data RGB from the timing controller 600. The data driver 500 may supply data signals to the data lines DL in response to the fourth driving control signal DCS. The data signals supplied to the data lines DL may be supplied to pixels PX selected by scan signals. To accomplish this, the data driver 500 may supply data signals to the data lines DL in synchronization with the scan signals.

Figure 2A:
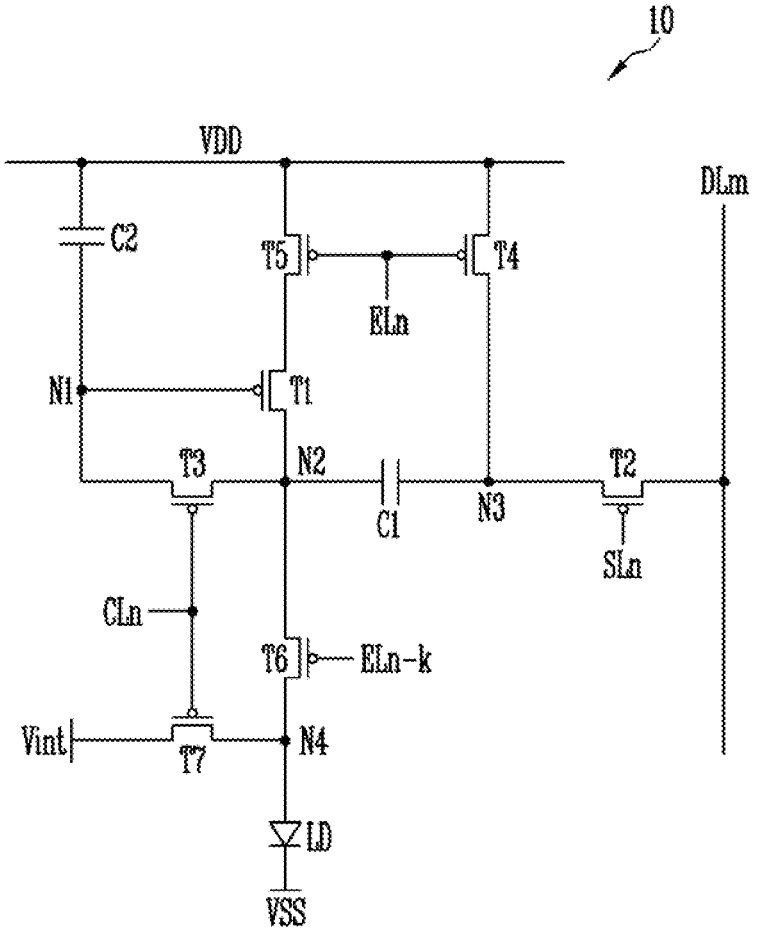
FIG. 2A is a circuit diagram illustrating a pixel in accordance with an exemplary embodiment of the present invention.

FIG. 2A is a circuit diagram illustrating a pixel in accordance with an exemplary embodiment of the present invention.

FIG. 2A illustrates a pixel 10 disposed on an n-th horizontal line (or an n-th pixel row) and coupled to an m-th data line DLm.

In an exemplary embodiment of the present invention, a preceding emission control line ELn−k may supply an emission control signal equal to an emission control signal to be supplied to an emission control line coupled to an n−k-th pixel row.

Referring to FIG. 2A, the pixel 10 may include a light emitting element LD, first, second, third, fourth, fifth, sixth and seventh transistors T1, T2, T3, T4, T5, T6 and T7, a first capacitor C1, and a second capacitor C2.

In an exemplary embodiment of the present invention, the first to seventh transistors T1 to T7 may be of the same type. For example, each of the first to seventh transistors T1 to T7 may be a P-channel metal oxide semiconductor (PMOS) transistor. Each of the first to seventh transistors T1 to T7 may include an active layer formed of a poly-silicon semiconductor. For example, the active layer of each of the first to seventh transistors T1 to T7 may be formed through a low temperature poly-silicon (LTPS) process.

A first electrode of the light emitting element LD may be electrically coupled to a second electrode (e.g., a drain electrode) of the first transistor T1, and a second electrode of the light emitting element LD may be coupled to the second power supply VSS. For example, the first electrode of the light emitting element LD may be coupled to a fourth node N4 to which one electrode of the sixth transistor T6 and one electrode of the seventh transistor T7 are coupled in common.

The light emitting element LD may emit light having a predetermined luminance corresponding to the amount of current (e.g., driving current) supplied from the first transistor T1. In an exemplary embodiment of the present invention, the light emitting element LD may be an organic light emitting diode including an organic light emitting layer. In this case, the first electrode of the light emitting element LD is an anode electrode, and the second electrode of the light emitting element LD is a cathode electrode. In the alternative, the first electrode of the light emitting element LD may be a cathode electrode, and the second electrode of the light emitting element LD may be an anode electrode.

In an exemplary embodiment of the present invention, the light emitting element LD may be an inorganic light emitting element formed of inorganic material. The light emitting element LD may include a plurality of inorganic light emitting elements that are coupled in parallel and/or series between the second power supply VSS and the second electrode of the first transistor T1.

The first transistor T1 may be electrically coupled between the first power supply VDD and the first electrode of the light emitting element LD. The first transistor T1 may generate a driving current and provide the driving current to the light emitting element LD. A gate electrode of the first transistor T1 may be coupled to the first node N1. The first transistor T1 may function as a driving transistor of the pixel 10. The first transistor T1 may control, in response to a voltage applied to the first node N1, the amount of current flowing from the first power supply VDD to the second power supply VSS via the light emitting element LD.

The first capacitor C1 may be coupled between a second node N2 corresponding to the second electrode of the first transistor T1 and a third node N3. For example, the second node N2 may be connected to the second electrode of the first transistor T1. The first capacitor C1 may store a voltage corresponding to a difference in voltage between the second node N2 and the third node N3.

The second capacitor C2 may be coupled between the first power supply VDD and the first node N1. The second capacitor C2 may store a voltage corresponding to a difference in voltage between the first power supply VDD and the first node N1.

In the case where a data signal is written to the pixel 10, the first node N1 and the second node N2 may have a voltage determined according to a capacitance ratio between the first capacitor C1 and the second capacitor C2 by charge sharing between the first capacitor C1 and the second capacitor C2.

The second transistor T2 may be coupled between the data line DLm and the third node N3. The second transistor T2 may include a gate electrode for receiving a scan signal. For example, the gate electrode of die second transistor T2 may be coupled to a scan line SLn (e.g., an n-th scan line). When a scan signal is supplied to the scan line SLn, the second transistor T2 may be turned on so that the data line DLm may be electrically coupled to the third node N3. Therefore, a data voltage (or a data signal) may be transmitted to the third node N3.

The third transistor T3 may be coupled between the first node N1 corresponding to the gate electrode of the first transistor T1 and the second node N2 (e.g., the drain electrode of the first transistor T1). The first node N1 may be connected to the gate electrode of the first transistor T1. The third transistor T3 may include a gate electrode for receiving a first control signal. For example, the gate electrode of the third transistor T3 may be coupled to a control line CLn (e.g., an n-th control line). When a control signal is supplied to the control line CLn, the third transistor T3 may be turned on so that the first node N1 may be electrically coupled to the second node N2. When the third transistor T3 is turned on, the voltage of the initialization power supply Vint may be supplied to the first node N1, or the first transistor T1 may have a diode connection form. In the case where the first transistor T1 has a diode connection form (in other words, is diode-connected), the threshold voltage of the first transistor T1 may be compensated for.

Therefore, the first transistor T1 may generate driving current set forth by the following [Equation 1] based on a data signal and the first and second capacitor C1 and C2.

$$Id=k[a(Vdd-V\text{data})]^2,\ a=CC2/(CC1+CC2), \qquad \text{[Equation 1]}$$

Here, Id may denote driving current, k may denote a characteristic value of the first transistor T1, Vdd may denote a voltage of the first power supply VDD, Vdata may denote a data signal, CC1 may denote a capacitance of the first capacitor C1, and CC2 may denote a capacitance of the second capacitor C2. The light emitting element LD may emit light at a luminance corresponding to the driving current Id.

In the description of FIG. 2 a signal line coupled to the gate electrode of the third transistor T3 and a signal which is supplied thereto are respectively referred to as a control line CLn and a control signal, it is to be understood that the control line CLn may be a scan line different from the scan line SLn. A scan signal of the scan line SLn may be supplied from the first scan driver 200, and a control signal of the control line CLn may be supplied from the second scan driver 300.

The fourth transistor T4 may be coupled between the first power supply VDD and the third node N3. The fourth transistor T4 may include a gate electrode for receiving an emission control signal.

In an exemplary embodiment of the present invention, the gate electrode of the fourth transistor T4 may be coupled to an emission control line ELn (e.g., an n-th emission control line). When an emission control signal is supplied to the emission control line ELn, the fourth transistor T4 may be turned on so that the voltage of the first power supply VDD may be supplied to the third node N3. Therefore, the voltage of the third node N3 may be initialized to the voltage of the first power supply VDD.

During a period in which the threshold voltage compensation of the first transistor T1 is performed, the fourth transistor T4 may be turned on. Therefore, the voltage (e.g., a direct current (DC) voltage) of the first power supply VDD may be used for the threshold voltage compensation of the first transistor T1.

The fifth transistor T5 may be coupled between the first power supply VDD and the first electrode of the first transistor T1. The fifth transistor T5 may include a gate electrode for receiving an emission control signal. For example, the gate electrode of the fifth transistor T5 may be coupled to the emission control line ELn. The fifth transistor T5 may be turned on when an emission control signal is supplied thereto. In this case, the first electrode of the first transistor T1 may be coupled to the first power supply VDD.

In the case where the fourth and fifth transistors T4 and T5 are turned on and the third transistor T3 is turned off, the high voltage of the first power supply VDD is supplied to the first electrode of the first transistor T1, so that the first transistor T1 may have an on-bias state.

The sixth transistor T6 may be coupled between the second node N2 corresponding to the second electrode of the first transistor T1 and the light omitting element LD. For example, the sixth transistor T6 may be connected to the first electrode of the light emitting element LD. The sixth transistor T6 may include a gate electrode for receiving a preceding emission control signal. For example, the gate electrode of the sixth transistor T6 may be coupled to a preceding emission control line ELn−k (e.g., an n−k-th emission control line).

For example, the preceding emission control line ELn−k may be a line diverged from an n−6-th emission control line ELn−6. In this case, each of the threshold voltage compensation period and the initialization period may correspond to approximately six horizontal cycles (6H). Alternatively, the preceding emission control line ELn−k may be an n−3-th emission control line ELn−3. In this case each of the threshold voltage compensation period and the initialization period may correspond to approximately three horizontal cycles (3H). Hereinafter, description will be made on the assumption that the preceding emission control line ELn−k is an n−6-th emission control line ELn−6.

However, this is only for illustrative purposes, and thus an emission control line from which the preceding emission control line is diverged is not limited to the foregoing example. For example, the preceding emission control line may be determined by the time required for the threshold voltage compensation, the number of pixel rows that are simultaneously controlled, the resolution, the length of one horizontal cycle (1H), etc.

When an emission control signal is supplied to the preceding emission control line ELn−k, the sixth transistor T6 is turned on so that the second node N2 may be electrically coupled with the fourth node N4.

In the case where both the fifth transistor T5 and the sixth transistor T6 are turned on, the light emitting element LD may emit light at a luminance corresponding to the voltage of the first node N1. In an exemplary embodiment of the present invention, in the case where the fifth transistor T5 is turned on and the sixth transistor T6 is turned off, the threshold voltage compensation of the first transistor T1 may be performed, or an on bias may be applied to the first transistor T1.

The seventh transistor T7 may be coupled between the light emitting element LD and the initialization power supply Vint. The fourth node N4 may be located on a path between the seventh transistor T7 and the light emitting element LD. The seventh transistor T7 may include a gate electrode for receiving a control signal. In an exemplary embodiment of the present invention, the gate electrode of the seventh transistor T7 may be coupled to the control line CLn. Therefore, the seventh transistor T7 and the third transistor T3 may be operated in substantially the same manner by the same control signal.

When a control signal is supplied to the control line CLn, the seventh transistor T7 may be turned on so that the voltage of the initialization power supply Vint may be supplied to the fourth node N4. Hence, the voltage of the fourth node N4 may be initialized to the voltage of the initialization power source Vint.

A period for which the transistor T2 is turned on and a period for the fourth and fifth transistors T4 and T5 are turned on may not overlap with each other. For example, when the third to fifth transistors T3 to T5 are turned on, the threshold voltage compensation of the first transistor T1 is performed. When the second and third transistors T2 and T3 are turned on, a data write operation may be performed. Therefore, the threshold voltage compensation period and the data write period may be separated from each other.

Due to the iteration of the supply of the emission control signals, the threshold voltage compensation and the pixel initialization operation (e.g., an operation of initializing the anode voltage of the light emitting element LD and an operation of initializing the gate voltage of the first transistor T1) may be repeatedly performed.

A detailed method of driving the pixel 10 will be described with reference to FIG. 3.

Figure 2B:
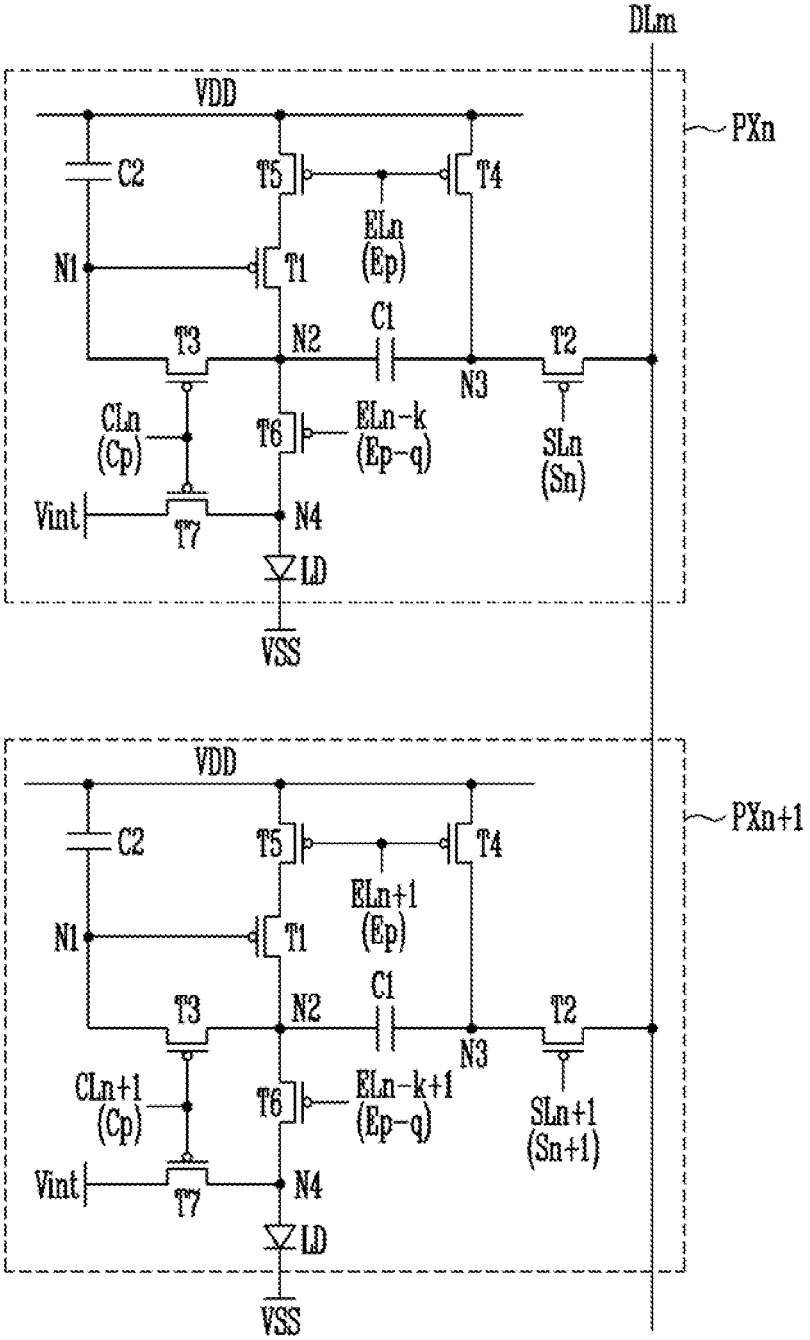
FIG. 2B is a circuit diagram for describing signals to be supplied to pixels illustrated in FIG. 2A.

FIG. 2B is a circuit diagram for describing signals to be supplied to the pixel of FIG. 2A.

Referring to FIGS. 2A and 2B, an n-th pixel PXn disposed on the n-th pixel row and an n+1-th pixel PXn+1 disposed on an n+1-th pixel row may have substantially the same pixel structure.

The following description will be made on the assumption that both the n-th pixel PXn and the n+1-th pixel PXn+1 are coupled to the m-th data line DLm.

An n-th scan signal Sn may be supplied to the n-th scan line SLn, and an n+1-th scan signal Sn+1 may be supplied to an n+1 scan line SLn+1. The n+1-th scan signal Sn+1 may be a scan signal obtained by shifting (e.g., delaying) the n-th scan signal Sn by one horizontal cycle (1H).

A p-th (p is a natural number) emission control signal Ep may be supplied in common to the n-th emission control line ELn and the n+1-th emission control line ELn+1. In other words, the n-th pixel PXn and the n+1-th pixel PXn+1 may be controlled in common by the same emission control signal Ep. Therefore, during one frame period, the number of emission control signals to be supplied to the display panel 100 may be less than the number of scan signals to be supplied thereto.

For example, in the case where one emission control signal is supplied in common to two emission control lines, the number of emission control signals may be half of the number of scan signals.

In an exemplary embodiment of the present invention, a p-th emission control signal Ep may be obtained by shifting (e.g., delaying) the p−1-th emission control signal Ep−1 by two or more horizontal cycles (e.g., 2H or more).

A p−q-th emission control signal Ep−q may be supplied in common to an n−k-th emission control line ELn−k and an n−k+1 emission control line ELn−k+1. Furthermore, the p-th emission control signal Ep may be obtained by shifting the p−q-th emission control signal Ep−q by q*2 or more horizontal cycles (e.g., 2 qH or more).

Hereinafter, description will be made on the assumption that n is greater than k and p is greater than q. However, the relationship between n and k and the relationship between p and q are arbitrarily set for the sake of explanation of signal supply timings. Therefore, it is to be understood that, even when n is greater than k, the supply timing of an emission control signal of FIG. 3 or the like are shifted and the emission control signal is supplied to corresponding emission control lines (e.g., ELn and ELn−k).

A p-th control signal Cp may be supplied in common to the n-th control line CLn and the n+1-th control line CLn+1. In other words, the n-th pixel PXn and the n+1-th pixel PXn+1 may be controlled in common by the same control signal Cp.

For example, in the case where one control signal is supplied in common to two control lines, the number of control signals may be half of the number of scan signals.

In an exemplary embodiment of the present invention, a p-th control signal Cp may be obtained by shifting (e.g., delaying) the p−1-th control signal Cp−1 by two or more horizontal cycles (e.g., 2H or more).

In other words, the scan lines may be controlled by the unit of a pixel row, and the emission control lines and the control lines may be controlled in common by the unit of preset consecutive pixel rows. Hence, the high speed driving operation of the display device 1000 having a driving frequency greater than 60 Hz may be easily implemented.

Figure 3:
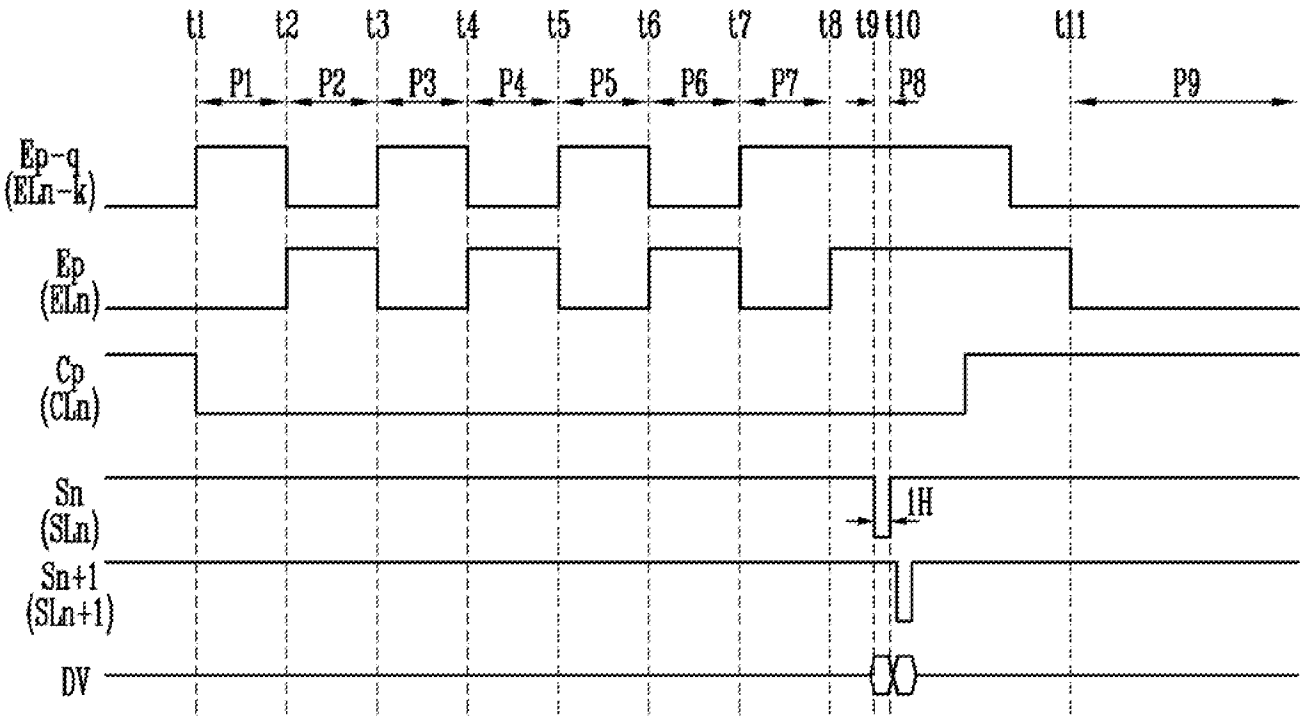
FIG. 3 is a timing diagram for describing an example of an operation of the pixel of FIGS. 2A and 2B.

FIG. 3 is a timing diagram for describing an example of an operation of the pixel of FIGS. 2A and 2B.

Referring to FIGS. 2A, 2B, and 3, a p-th emission control signal Ep may be supplied to the n-th emission control line ELn, n-th scan signal Sn may be supplied to the n-th scan line SLn, and a p-th control signal Cp may be supplied to the n-th control line CLn. Furthermore, a preceding emission control signal Ep−q may be supplied to the preceding emission control line ELn−k. An n+1-th scan signal Sn+1 may be supplied to the n+1-th scan line Sn+1.

Hereinafter, for the sake of explanation, the term "n-th emission control line ELn" may be used interchangeably with the term "emission control line ELn", the term "p-th emission control signal Ep" may be used interchangeably with the term "emission control signal Ep, the term "n-th control line SLn" may be used interchangeably with "scan line SLn", the term "n-th scan signal Sn" may be used interchangeably with the term "scan signal Sn, the term" n-th control line CLn" may be used interchangeably with the term "control line CLn", and the term "p-th control signal Cp" may be used interchangeably with the term "control signal Cp".

An emission control signal Ep, a preceding emission control signal Ep−q, and a control signal Cp may be supplied in common to the n-th pixel PXn and the n+1-th pixel PXn+1.

In an exemplary embodiment of the present invention, the emission control signal Ep may be obtained by shifting the preceding emission control signal Ep−q by approximately six horizontal cycles (6H). Furthermore, the preceding emission control signal Ep−q may be the same as an emission control signal which is supplied to an n−6-th pixel (e.g., an n−6-th emission control line ELn−6).

The timing diagram of FIG. 3 illustrates a portion of a waveform during one frame period. During a period (e.g., a ninth period P9) in which each of the emission control signal Ep and the preceding emission control signal Ep−q has a gate-on level (e.g., a low level), the n-th pixel PXn and the n+1-th pixel PXn+1 may emit light.

As illustrated in FIG. 3, the emission control signal Ep may have four gate-off periods (e.g., periods in which the emission control signal Ep has a logical high voltage). However, this is only for illustrative purposes. For example, the emission control signal Ep during one frame period may have five or more gate-off periods. In addition, the emission control signal Ep may have less than four gate-off periods.

The gate-on level of each of the scan signal Sn, the control signal Cp, and the emission control signals Ep and Ep−q may be a low voltage.

At a first time t1, the preceding emission control signal Ep−q may make a transition from a gate-on level to a gate-off level. Thereby, the sixth transistor T6 may be turned off. The anode electrode of the light emitting element LD may float from the fourth node N4 by turning off the sixth transistor T6. Thus, a kick back phenomenon with respect to the anode voltage may occur. In this case, a pixel having a black gray-scale may be bright, rather than black.

To prevent this from happening, at the first time t1, the control signal Cp may make a transition from a gate-off level to a gate-on level. Therefore, at the first time t1, the third and seventh transistors T3 and T7 may be turned on. The initialization power source Vint may be supplied to the fourth node N4.

Since the fourth transistor T4 remains turned on, the voltage of the first power supply VDD may be supplied to the third node N3.

During a first period P1 from the first time t1 to a second time t2, the voltage of the initialization power supply Vint may be supplied to the third node N3 and the fourth node N4. In other words, the first period P1 may be a first initialization period in which the anode voltage of the light emitting element LD is initialized.

Although FIG. 3 illustrates that the transition time of the preceding emission control signal Ep−q is the same as that of the control signal Cp, the control signal Cp may transition to a gate-on level at a time between the first time t1 and the second time t2. In other words, the control signal Cp may transition to the gate-on level after the preceding emission control signal Ep−q transitioned to the gate-off level.

In an exemplary embodiment of the present invention, the control signal Cp may be maintained at the gate-on level before the emission time of the pixels PXn and PXn+1, and the third and seventh transistors T3 and T7 may be turned on before the emission time of the pixels PXn and PXn+1. For example, the third and seventh transistors T3 and T7 may remain turned on from the first time t1 to a tenth time t0.

At the second time t2, the preceding emission control signal Ep−q may transition from the gate-off level to the gate-on level, and the emission control signal Ep may transition from the gate-on level to the gate-off level. At the second time t2, the fourth and fifth transistors T4 and T5 may be turned off, and the sixth transistor T6 may be turned on. Here, the third and seventh transistors T3 and T7 may remain turned on. Hence, the voltage of the initialization power supply Vint may be supplied to the gate electrode (e.g., the first node N1) of the first transistor T1 through the third and sixth transistors T3 and T6.

During a second period P2 from the second time t2 to a third time t3, the preceding emission control signal En−k and the emission control signal En may have waveforms opposite to each other. Therefore, the second period P2 may be a second initialization period in which the anode voltage of the light emitting element LD and the gate voltage of the first transistor T1 are initialized. During the second period P2, the gate voltage and the drain voltage (e.g., the voltage of the second node N2) of the first transistor T1 may correspond to the voltage of the initialization power supply Vint.

Furthermore, since the fifth transistor T5 is in a turned-off state during the second period P2, the source electrode (e.g., the first electrode) of the first transistor T1 may have a voltage corresponding to the sum of the voltage of the initialization power supply Vint and the threshold voltage of the first transistor T1. Hence, during the second period P2, the first transistor T1 may have an off-bias state. Consequently, the second initialization period may be an off-bias period for the first transistor T1.

The second initialization period may correspond to a period in which the preceding emission control signal Ep−q and the control signal Cp have a gate-on level and the emission control signal Ep has a gate-off level.

At the third time t3, the preceding emission control signal Ep−q may transition from the gate-on level to the gate-off level, and the emission control signal Ep may transition from the gate-off level to the gate-on level. Therefore, the fourth and fifth transistors T4 and T5 may be turned on, and the sixth transistor T6 may be turned off. Since the third transistor T3 is in a turned-on state, the first transistor T1 may have a diode connection form. A voltage corresponding to the threshold voltage Vth of the first transistor T1 may be stored in the second capacitor C2.

Since the first transistor T1 has a diode connection form during a third period P3 from the third time t3 to a fourth time t4, the threshold voltages of the first transistor T1 may be compensated for. In other words, the third period P3 may be a threshold voltage compensation period.

During the third period P3, the threshold voltage compensation may be performed by the voltage of the first power supply VDD that is a constant voltage source. Therefore, the threshold voltage compensation operation may be performed based on a fixed voltage rather than a data signal (e.g., a data voltage) that is changeable depending on pixels and/or frames.

At the fourth time t4, the preceding emission control signal Ep−q may transition from the gate-off level to the gate-on level again, and the emission control signal Ep may transition from the gate-on level to the gate-off level again. At the fourth time t4, the fourth and fifth transistors T4 and T5 may be turned off, and the sixth transistor T6 may be turned on. Hence, the voltage of the initialization power supply Vint may be supplied to the gate electrode (e.g., the first node N1) of the first transistor T1 through the third and sixth transistors T3 and T6 again.

During the fourth period from the fourth time t4 to the fifth time t5, substantially the same driving operation as that of the second period P2 may be performed. In other words, the fourth period P4 may correspond to the second initialization period (and the off-bias period) in which the anode voltage of the light emitting element LD and the gate voltage of the first transistor T1 are initialized and an off-bias is applied to the first transistor T1.

At the fifth time t5, the preceding emission control signal Ep−q may transition from the gate-on level to the gate-off level, and the emission control signal Ep may transition from the gate-off level to the gate-on level. At the fifth time t5, the fourth and fifth transistors T4 and T5 may be turned off, and the sixth transistor T6 may be turned off. Therefore, a fifth period P5 from the fifth time t5 to a sixth time t6 may be substantially the same threshold voltage compensation period as that of the third period P3.

Depending on a gray scale in which the corresponding pixel (e.g., the n-th pixel PXn) emits light (in other words, depending on the level of the data signal) during the preceding frame period, the driving current of the first transistor T1 may vary. Therefore, depending on the data signal of the preceding frame period, a deviation in compensation for the threshold voltage of the first transistor T1 may occur. In the pixel (e.g., 10 of FIG. 2) and the display device 1000 including the pixel in accordance with exemplary embodiments of the present invention, the number of threshold voltage compensation operations may be increased so that the threshold voltage compensation time accumulated in one frame period may be increased. Therefore, a deviation in compensation for the threshold voltage of the first transistor T1 depending on the level of the data signal during the preceding frame period may be removed.

For example, the pixel 10 may perform the threshold voltage compensation operation during the third period P3, the fifth period P5, and a seventh period P7. In this case, the compensation deviation may be removed by iterating the threshold voltage compensation operation. It is to be understood, however, that the threshold compensation operation may be performed more or less than three times during a frame period.

At the sixth time t6, the preceding emission control signal Ep−q may transition from the gate-off level to the gate-on level again, and the emission control signal Ep may transition from the gate-on level to the gate-off level again. During the sixth period P6 from the sixth time t6 to a seventh time t7, substantially the same driving operation as that of the second period P2 may be performed. In other words, the sixth period P6 may correspond to the second initialization period in which the anode voltage of the light emitting element LD and the gate voltage of the first transistor T1 are initialized.

At the seventh time t7, the preceding emission control signal Ep−q may transition from the gate-on level to the gate-off level, and the emission control signal En may transition from the gate-off level to the gate-on level. At an eighth time t8, the emission control signal Ep may transition to a gate-off level. Therefore, a seventh period P7 from the seventh time t7 to the eighth time t8 may be substantially the same threshold voltage compensation period as that of the third period P3.

As such, the emission control signal Ep may have a gate-on level during the first, third, fifth, and seventh periods P1, P3, P5, and P7, and may have a gate-off level during the second, fourth, and sixth periods P2, P4, and P6. During the first to seventh periods P1 to P7, the preceding emission control signal Ep−q may have a waveform opposite to that of the emission control signal Ep and be supplied to the pixels PXn and PXn+1. Therefore, the threshold voltage compensation period and the initialization period (e.g., the second initialization period) may be alternately repeated a plurality of times. Therefore, a deviation in compensation for the threshold voltage of the first transistor T1 depending on the level of the data signal during the preceding frame period may be removed. In addition, as an off-bias is periodically applied to the first transistor T1, the hysteresis characteristics of the first transistor T1 may be improved.

The gate voltage of the first transistor T1 may fluctuate due to a kickback phenomenon caused by repetitive changes in the level of the emission control signals Ep and Ep−q used for the repetition of the threshold voltage compensation period and the initialization period. However, since the third transistor T3 is kept in a turned-on state, a data voltage may be stored in the second capacitor C2 by charge sharing between the first capacitor C1 and the second capacitor C2. Therefore, the gate voltage of the first transistor T1 may be stably changed based on a capacitance ratio between the first capacitor C1 and the second capacitor C2.

At a ninth time t9, the scan signal Sn may transition from a gate-off level to a gate-on level, and the second transistor T2 may be turned on. Thereby, a data signal DV may be supplied to the third node N3. During an eighth period P8 from the ninth time t9 to a tenth time t10, a data signal DV may be written to the n-th pixel PXn, and a voltage corresponding to the threshold voltage Vth and the data signal DV may be stored in the first and second capacitors C1 and C2 by charge sharing. In other words, the eighth period P8 may be a data write period.

In an exemplary embodiment of the present invention, in the eighth period P8, the length (e.g., pulse width) of a scan signal Sn, may correspond to one horizontal cycle (1H). Furthermore, an n+1-th scan signal Sn+1 is sequentially supplied to the n+1-th scan line SLn+1, and an operation of writing data to the n+1-th pixel PXn+1 may be performed in response to the n+1-th scan signal Sn+1.

However, this is only for illustrative purposes. For example, during a period in which each of the preceding emission control signal Ep−q and the emission control signal Ep has a gate-off level, the number of scan signals to be supplied may be increased. In this case, three or more pixel rows may be controlled in common by one emission control signal EP and one control signal Cp.

Thereafter, the control signal Cp may transition to a gate-off level. In other words, the control signal Cp may transition to the gate-off level after the data write period. In addition, the preceding emission control signal Ep−q may transition to a gate-of level. Therefore, the sixth transistor T6 may be turned on, and the third and seventh transistors T3 and T7 may be turned off.

In an exemplary embodiment of the present invention, the first to eighth periods P1 to P8 may be included in a non-emission period of one frame period of the pixel 10.

Subsequently, at an eleventh time t11, the emission control signal Ep may transition from a gate-off level to a gate-on level, and the fourth and fifth transistors T4 and T5 may be turned on. Hence, the light emitting element LD may emit light based on a voltage stored in the second capacitor C2. For example, the light emitting element LD may emit light corresponding to driving current defined by [Equation 1]. The ninth period P9 in which each of the emission control signal Ep and the preceding emission control signal Ep−q has a gate-on level may corresponding to a period in which the pixels PXn and PXn+1 emit light.

As described above, in the pixel in accordance with exemplary embodiments of the present invention a threshold voltage compensation operation the third period P3) of the first transistor T1 (e.g., the driving transistor) and the data write operation (e.g., the eighth period P8) may be separately performed. For example, the threshold voltage compensation operation may be performed prior to the data write operation. The threshold voltage compensation period may be easily controlled by adjusting the waveform of the emission control signal Ep. Therefore, a sufficient amount of time required to compensate for the threshold voltage compensation of the display device 1000 that performs high speed driving is secured. Due to the exemplary embodiments of the present invention, a demultiplexer typically required to supply data signals for high speed driving with a conventional technique can be omitted. Therefore, dead space (e.g., a bezel) and the production cost of the display device 1000 may be reduced. Furthermore, the threshold voltage compensation period and the initialization period (e.g., the second initialization period) may be alternately repeated a plurality of times. Therefore, a deviation in compensating for the threshold voltage of the first transistor T1 according to the level of the data signal during the preceding frame period may not occur.

Figure 4:
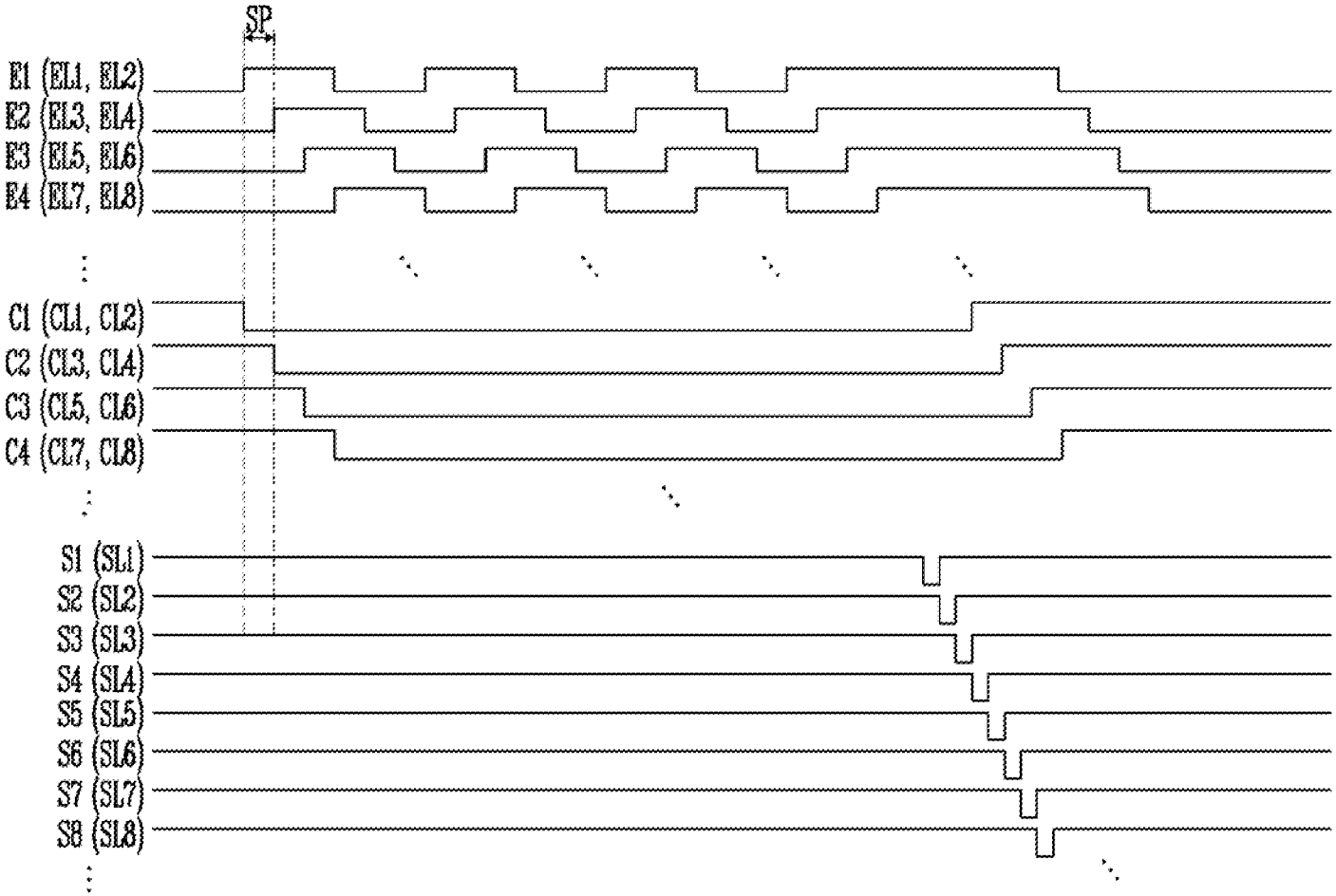
FIG. 4 is a timing diagram for describing an example of an operation of the display device of FIG. 1.

FIG. 4 is a timing diagram for describing an example of an operation of the display device of FIG. 1.

Referring to FIGS. 1, 2B, 3, and 4 an emission control signal and a control signal may be supplied to two pixels. Furthermore, the emission control signal and the control signal may be sequentially output at a predetermined shift interval SP.

It is to be understood that a k-th signal line (e.g., an emission control, a control line, or a scan line) for supplying a k-th signal (e.g., an emission control signal, a control signal, or a scan signal) is a signal line coupled to pixels included in a k-th pixel row.

A first emission control signal E1 may be supplied in common to first and second emission control lines EL1 and EL2. Likewise, a first control signal C1 may be supplied to first and second control lines CL1 and CL2. Therefore, a shift interval SP may be approximately two horizontal cycles (2H). However, this is only for illustrative purposes, and the shift interval SP may be determined according to the number of pixel rows to which an emission control signal (and a control signal) is supplied in common. For example, in the case where the first emission control signal E1 is supplied in common to the first to third emission control lines EL1, EL2, and EL3 the shift interval SP may correspond to approximately three horizontal cycles 3H. FIG. 4 further shows that a second emission control signal E2 may be supplied in common to third and fourth emission control lines EL3 and EL4, a third emission control signal E3 may be supplied in common to fifth and sixth emission control lines EL5 and EL6, and a fourth emission control signal E4 may be supplied in common to seventh and eighth emission control lines EL7 and EL8. In addition, FIG. 4 shows that a second control signal C2 may be supplied in common to third and fourth control lines CL3 and CL4, a third control signal C3 may be supplied in common to fifth and sixth control lines CL5 and CL6, and a fourth control signal C4 may be supplied in common to seventh and eighth control lines CL7 and CL8.

A scan signal S1 to S8 may be sequentially supplied to each of the scan lines SL1 to SL8 at an interval of one horizontal cycle (1H). In other words, the shift interval SP of the emission control signal and the control signal may be longer than a shift interval of the scan signal.

In the case where the display device 1000 includes i pixel rows (here, i is a natural number), the first scan driver 200 may output i scan signals, the second scan driver 300 may output i/2 control signals, and the emission driver 400 may output i/2 emission control signals. Hence, the power consumption of the display device 1000 that is driven at high speed may be reduced.

Figure 5:
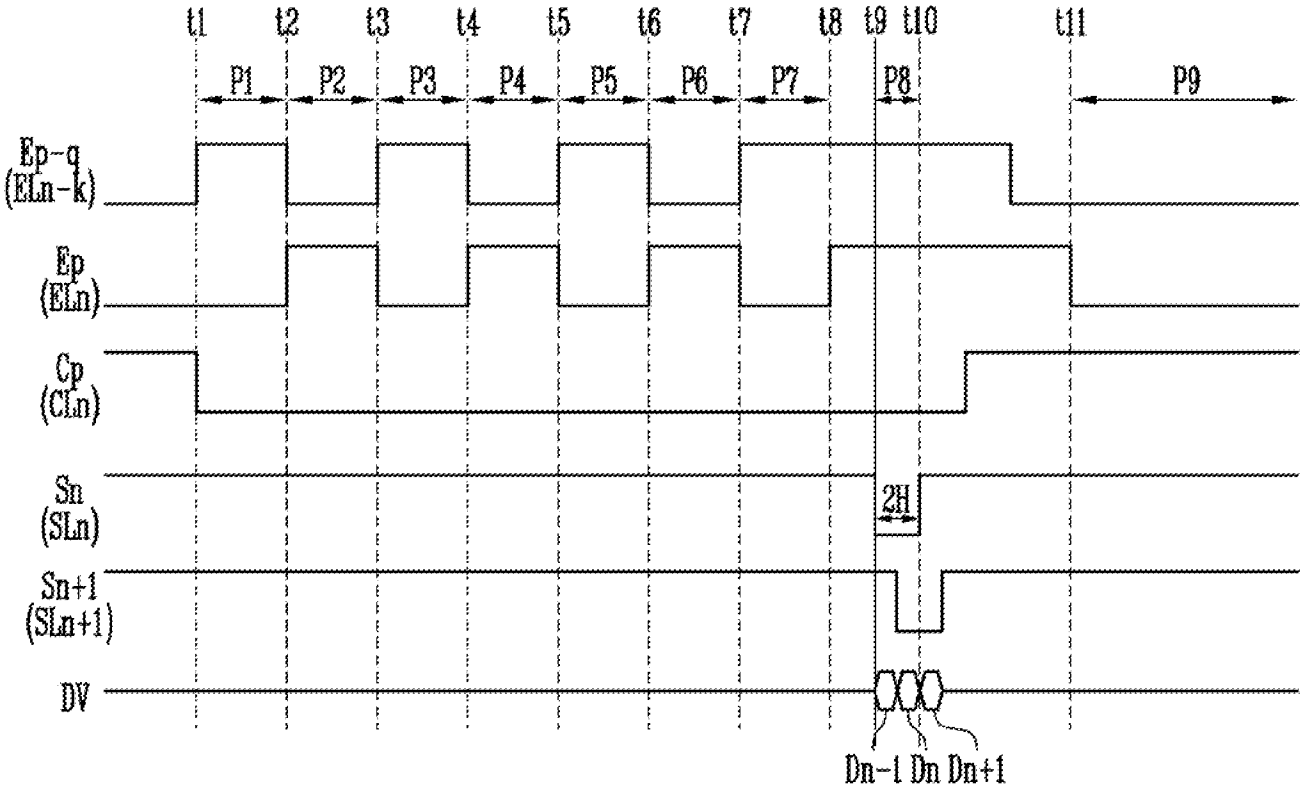
FIG. 5 is a timing diagram for describing an example of an operation of the pixels of FIGS. 2A and 2B.

FIG. 5 is a timing diagram for describing an example of an operation of the pixels of FIGS. 2A and 2B.

The operation of the pixel of FIG. 5, other than the length of a scan signal, is the same as that of the pixel of FIG. 3. Therefore, like reference numerals may be used to designate components equal to or similar to those of FIG. 3, and thus, a repetitive explanation may be omitted.

Referring to FIGS. 2B and 5, the length (e.g., the pulse width) of the scan signal Sn or Sn+1 may be equal to or greater than two horizontal cycles (2H).

For example, the eighth period P8 may correspond to two horizontal cycles 2H. An n−1-th data signal Dn−1 and an n-th data signal Dn may be sequentially supplied to the third node N3 of the n-th pixel PXn in response to an n-th scan signal Sn. Since the second transistor T2 is turned off after the n-th data signal Dn has been supplied, the light emitting element LD of the n-th pixel PXn may emit light in response to the n-th data signal Dn.

Furthermore, since the n-th data signal to behind the n−1-th data signal Dn−1 is supplied while the n-th scan signal Sn is maintained at a gate-on level, a sufficient amount of time required to appropriately supply the n-th data signal Dn is secured.

A portion of the n−1-th scan signal Sn+1 may overlap with a portion of the n-th scan signal Sn. In other words, the n+1-th scan signal Sn+1 and the n-th scan signal Sn may have the gate-on level at the same time. For example, in the case where the length of each of the scan signals Sn and Sn+1 corresponds to two horizontal cycles (e.g., 2H), the n+1-th scan signal Sn+1 and the n-th scan signal Sn may overlap with each other during one horizontal period 1H. The n-th data signal Dn and an n+1-th data signal Dn+1 may be sequentially supplied to the third node N3 of the n+1-th pixel PXn+1 in response to the n+1-th scan signal Sn+1. Thereby, the light emitting element LD of the n+1-th pixel PXn+1 may emit light in response to the n+1-th data signal Dn+1.

In an exemplary embodiment of the present invention, the length of the third period P3, which is a threshold voltage compensation period, may be longer than the eighth period P8 which is a data write period. Therefore, a sufficient amount of time required for the threshold voltage compensation may be secured.

However, this is only for illustrative purposes, and the eighth period P8 may be equal to or longer than three horizontal cycles (e.g., 3H) or four horizontal cycles (e.g., 4H) depending on a driving frequency and/or resolution of the display device 1000. Since the eighth period P8 is equal to or longer than two horizontal cycles (e.g., 2H), driving periods of a plurality of adjacent pixel rows may overlap with each other. Therefore, the pixel and the method of driving the pixel according to an exemplary embodiment of the present invention may be easily applied to a high-resolution display device and may be used to easily implement the high speed driving.

Figure 6:
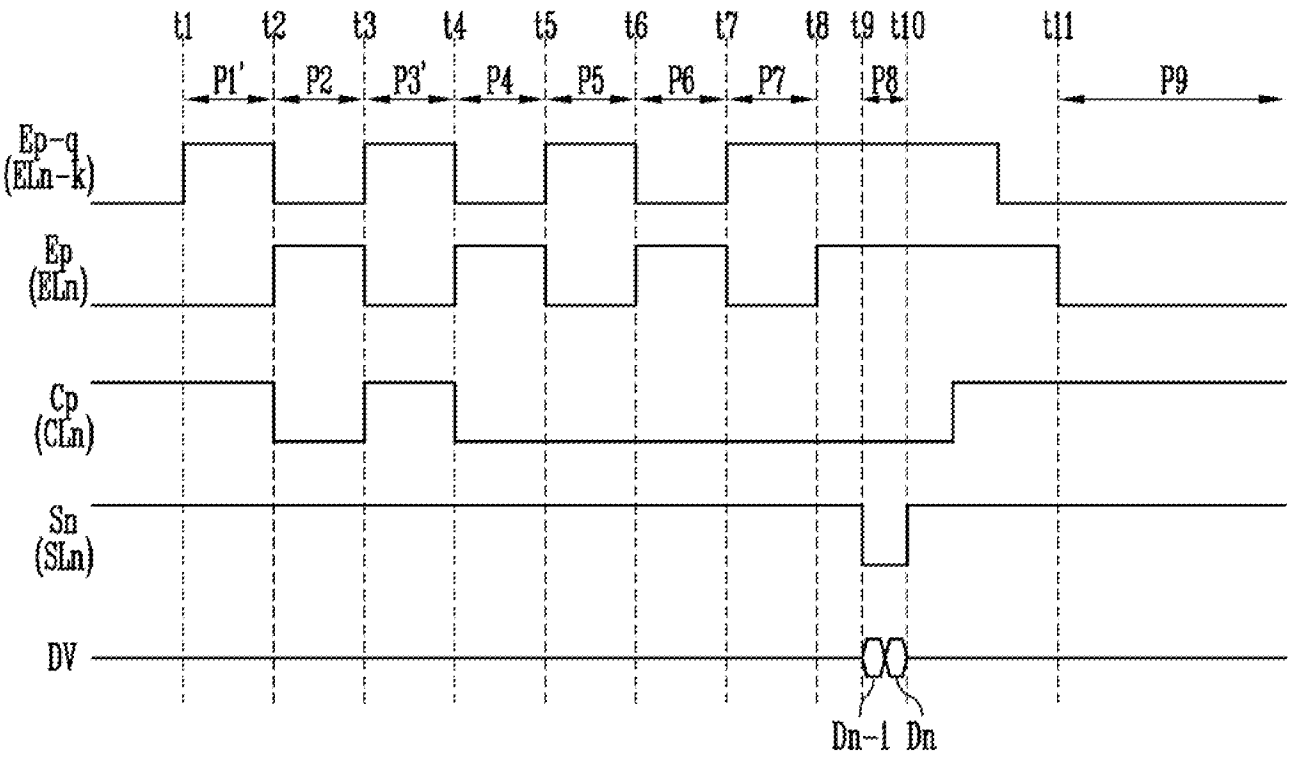
FIG. 6 is a timing diagram for describing an example of an operation of the pixels of FIGS. 2A and 2B.

FIG. 6 is a timing diagram for describing an example of an operation of the pixels of FIGS. 2A and 2B.

The operation of the pixel of FIG. 6, other than operations in a first period P1' and a third period P3' and the waveform of a control signal Cp, is the same as that of the pixel described with reference to FIG. 3 or 5. Therefore, like reference numerals may be used to designate components equal to or similar to those of FIG. 3 or 5, and thus, a repetitive explanation may be omitted.

Referring to FIGS. 2A and 6, one frame period may include first to ninth periods P1', P2, P3', P4, P5, P6, P7, P8, and P9.

In an exemplary embodiment of the present invention, the control signal Cp may have a gate-on level during the second, fourth, fifth, sixth, seventh, and eighth periods P2, P4, P5, P6, P7, and P8 and a gate-off level during the first, third, and ninth periods P1', P3' and P9.

During the first period P1', the emission of the light emitting element LD may be suspended by turning off the third, sixth, and seventh transistors T3, T6, and T7.

During the second, fourth, and sixth periods P2, P4, and P6, the sixth transistor T6 may be turned on, and the fourth and fifth transistors T4 and T5 may be turned off. Therefore, during the second, fourth, and sixth periods P2, P4, and P6, the anode voltage of the light emitting element LD and the gate voltage of the first transistor T1 may be initialized. Furthermore, since the connection between the first electrode (e.g., the source electrode) of the first transistor T1 and the first power supply VDD is interrupted, the first transistor T1 may have an off-bias state.

During the fifth and seventh periods P5 and P7, the sixth transistor T6 may be turned off, and the fourth and fifth transistors T4 and T5 may be turned on. Thus, during the fifth and seventh periods P5 and P7, the threshold voltage of the first transistor T1 may be compensated for.

During the third period P3', the control signal Cp may have a gate-off level. Hence, during the third period P3', the third and seventh transistors T3 and T7 may be turned off. During the third period P3', the fourth and fifth transistors T4 and T5 may be turned on, and the sixth transistor T6 may be turned off.

During the second period P2, the voltage of the initialization power supply Vint is applied to the gate electrode (e.g., the first node N1) of the first transistor T1. Thus, when the third period P3' starts, the voltage of the first node N1 may be a low voltage corresponding to the voltage of the initialization power supply Vint. During the third period P3', a high voltage of the first power supply VDD may be supplied to the first electrode of the first transistor T1 by turning on the fourth and fifth transistors T4 and T5. Hence, during the third period P3', an on-bias may be applied to the first transistor T1.

After the second period P2 in which the initialization is performed and an off-bias is applied to the third transistor T1, the third period P3' in which an on-bias is applied to the first transistor T1 may be provided. In addition, on-bias application and off-bias application are repeatedly performed in subsequent time periods. Therefore, hysteresis characteristics (e.g., a threshold voltage shift) of the first transistor T1 may be improved.

Consequently, in the pixel and display device described with reference to FIG. 6, a deviation in the threshold voltage of the first transistor T1 may be removed, and the hysteresis characteristics thereof may be removed or mitigated. Therefore, image failure (e.g., a flicker, a color-shifting phenomenon, or luminance degradation) in high-frequency driving (e.g., using a driving frequency equal to or greater than 70 Hz) or low-frequency driving (e.g., using a driving frequency equal to or greater than 30 Hz) be mitigated.

Figure 7A:
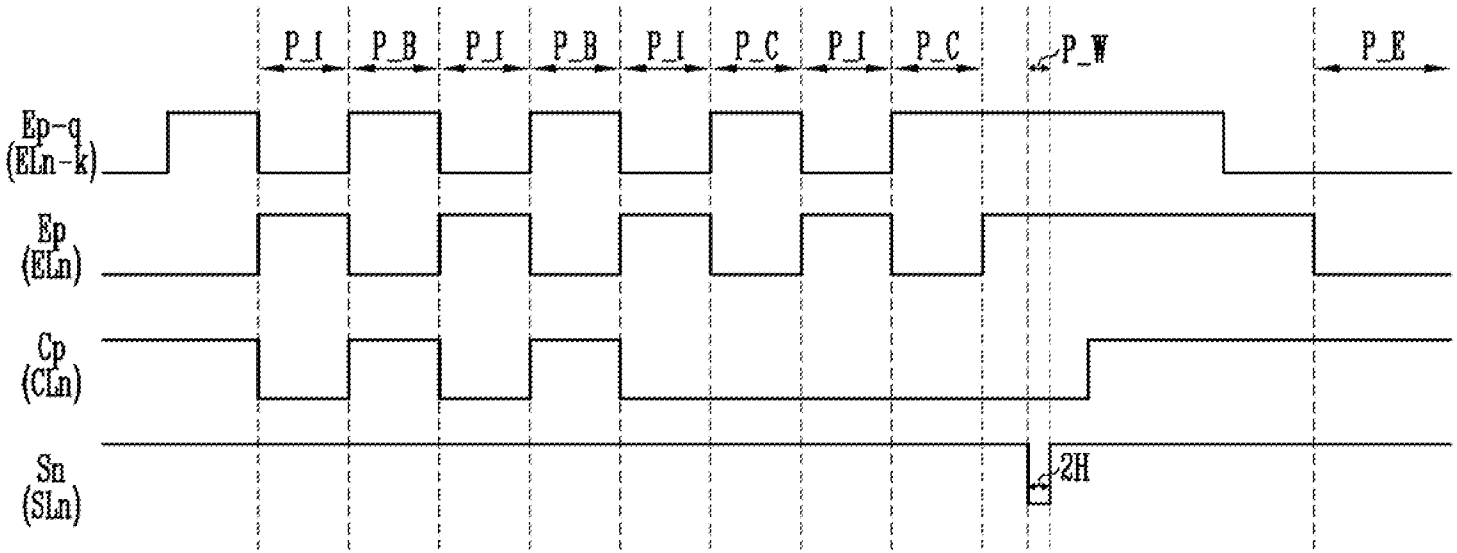
FIG. 7A is a timing diagram for describing an example of an operation of the pixel of FIG. 2A.
Figure 7B:
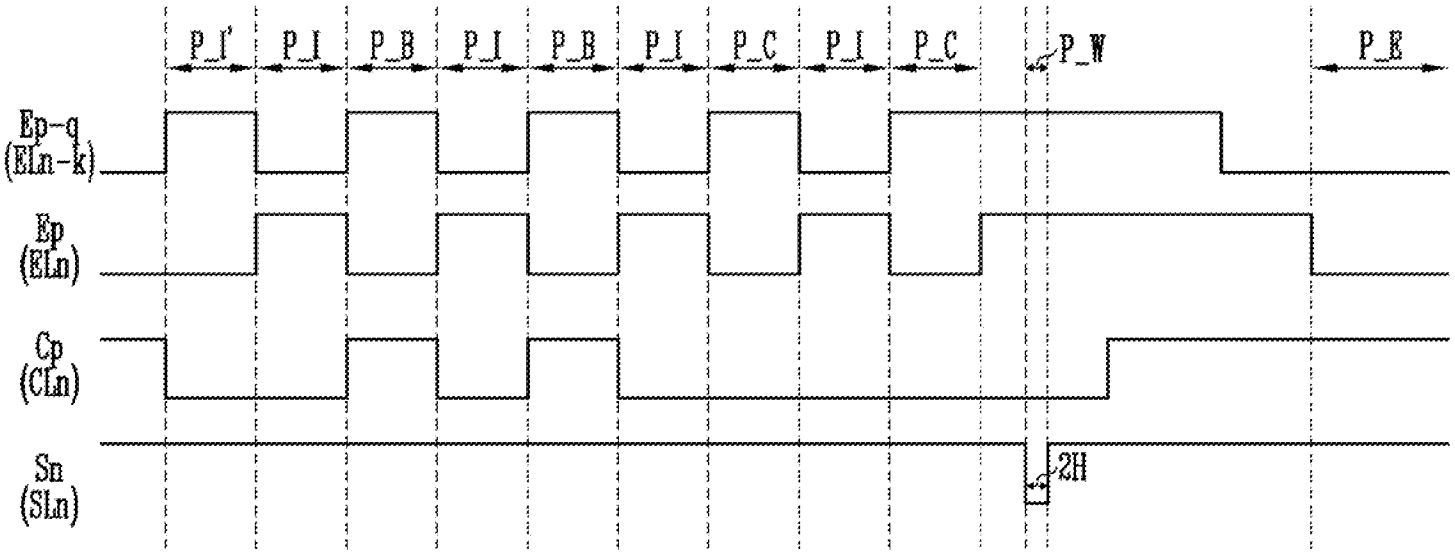
FIG. 7B is a timing diagram for describing an example of an operation of the pixel of FIG. 2A.

FIG. 7 is a timing diagram for describing an example of an operation of the pixel of FIG. 2A. FIG. 7B is a timing diagram for describing an example of an operation of the pixel of FIG. 2A.

The operation of the pixel of FIGS. 7A and 7B, other than the number of on-bias periods P_B, is the same as that of the pixel according to FIG. 6. Therefore, like reference numerals may be used to designate components equal to or similar to those of FIG. 6, and thus, a repetitive explanation may be omitted.

Referring to FIGS. 2A, 7A, and 7B, one frame period may include a plurality of initialization periods P_I, a plurality of on-bias periods P_B a plurality of compensation periods P_C, a write period P_W, and an emission period P_E.

In an exemplary embodiment of the present invention, as illustrated in FIGS. 7A and 7B, during one frame period, a data signal may be written to the pixel 10 after four initialization (and off-bias) operations, two on-bias operations, and two threshold voltage compensation operations have been performed. However, this is only illustrative purposes, and the number of initialization operations, on-bias operations, or threshold voltage compensation operations is not limited thereto.

In an exemplary embodiment of the present invention, during each of the initialization periods P_I, the on-bias periods P_B, and the compensation periods P_C, a switching operation of each of the fourth and fifth transistors T4 and T5 may be performed in reverse to a switching operation of the sixth transistor T6. For example, when the fourth and fifth transistors T4 and T5 are turned on, the sixth transistor T6 may be turned off. When the fourth and fifth transistors T4 and T5 are turned off, the sixth transistor T6 may be turned on.

During each initialization period P_I, each of the preceding emission control signal Ep−q and the control signal Cp may have a gate-on level. During the initialization period P_I, the emission control signal Ep may have a gate-off level. Therefore, during the initialization period P_I, the third, sixth, and seventh transistors T3, T6, and T7 may be turned on so that the anode voltage of the light emitting element LD and the gate voltage of the first transistor T1 may be initialized by the voltage of the initialization power supply Vint. During the initialization period P_I, both the anode voltage of the light emitting element LD and the gate voltage of the first transistor T1 may be initialized. In an exemplary embodiment of the present invention, during the initialization period P_I, the first transistor T1 may enter an off-bias state.

During each of the on-bias periods P_B, each of the preceding emission control signal Ep−q and the control signal Cp may have a gate-off level. During the on-bias period P_B, the emission control signal Ep may have a gate-on level. Hence, during the on-bias period P_B, the first transistor T1 may have an on-bias state.

During each compensation period P_C, each of the emission control signal Ep and the control signal Cp may have a gate-on level. During the compensation period P_C, the preceding emission control signal Ep−q may have a gate-off level. Hence, during the compensation period P_C, the third, fourth, and fifth transistors T3, T4, and T5 may be turned on, the sixth transistor T6 may be turned off, and the threshold voltage compensation operation of the first transistor T1 may be performed. The compensation period P_C may be adjusted depending on the length of the gate-on period of the emission control signal Ep.

During the write period P_W, each of the scan signal Sn and the control signal Cp may have a gate-on level. During the write period P_W, each of the preceding emission control signal Ep−q and the emission control signal Ep may have a gate-off level. Therefore, the second and third transistors T2 and T3 may be turned on, and the fourth, fifth, and sixth transistors T4, T5, and T6 may be turned off. During the write period P_W, the voltage of the data signal may be stored in the pixel 10. In an exemplary embodiment of the present invention, the write period P_W and the scan signal Sn each may have a length equal to or greater than two horizontal cycles (2H).

During the emission period P_E, each of the preceding emission control signal Ep−q and the emission control signal Ep may have a gate-on level. During the emission period P_E, each of the scan signal Sn and the control signal Cp may have a gate-off level. During the emission period P_E, the fifth and sixth transistors T5, and T6 may be turned on, and the second, third, fourth, and seventh transistors T2, T3, T4, and T7 may be turned off. Thereby, the light emitting element LD may emit light in response to a current data signal.

As such, in a non-emission period of each frame, the initialization (and the off-bias application) operation, the on-bias application operation, and the threshold voltage compensation operation each may be performed a plurality of times.

As illustrated in FIG. 7B, the non-emission period of each frame may further include an anode initialization period P_I' before the first initialization period P_I.

During each compensation period P_C, each of the emission control signal Ep and the control signal Cp may have a gate-on level. During the anode initialization period P_I', the preceding emission control signal Ep−q may have a gate-off level. Therefore, during the anode initialization period P_I', the anode voltage of the light emitting element LD may be initialized by the turned-on seventh transistor T7 and the turned-off sixth transistor T6.

Figure 8:
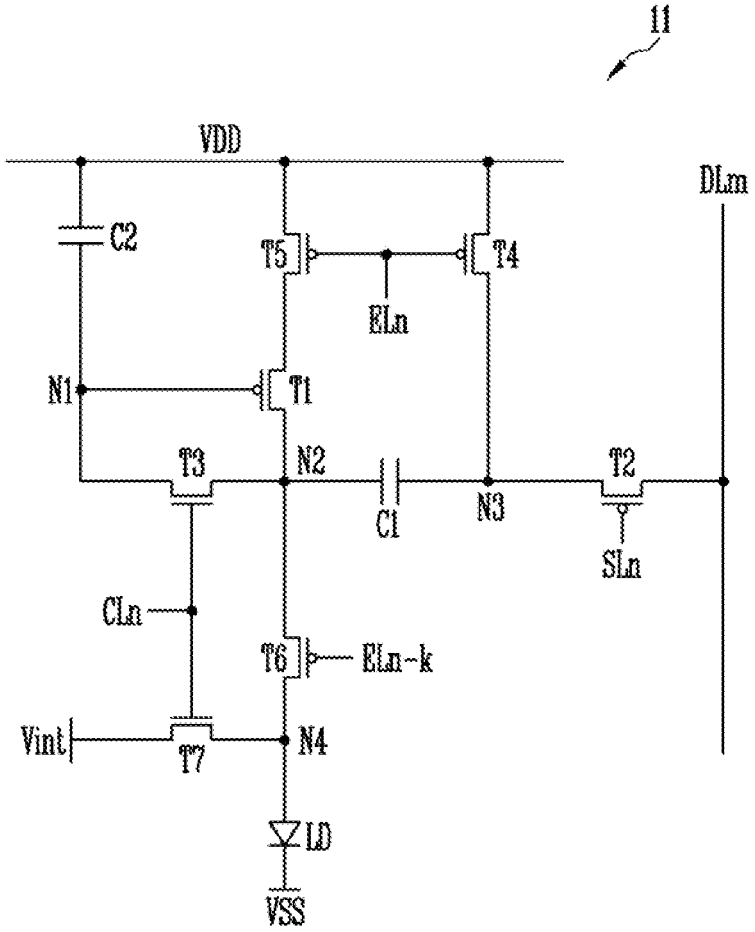
FIG. 8 is a circuit diagram illustrating a pixel in accordance with an exemplary embodiment of the present invention.
Figure 9:
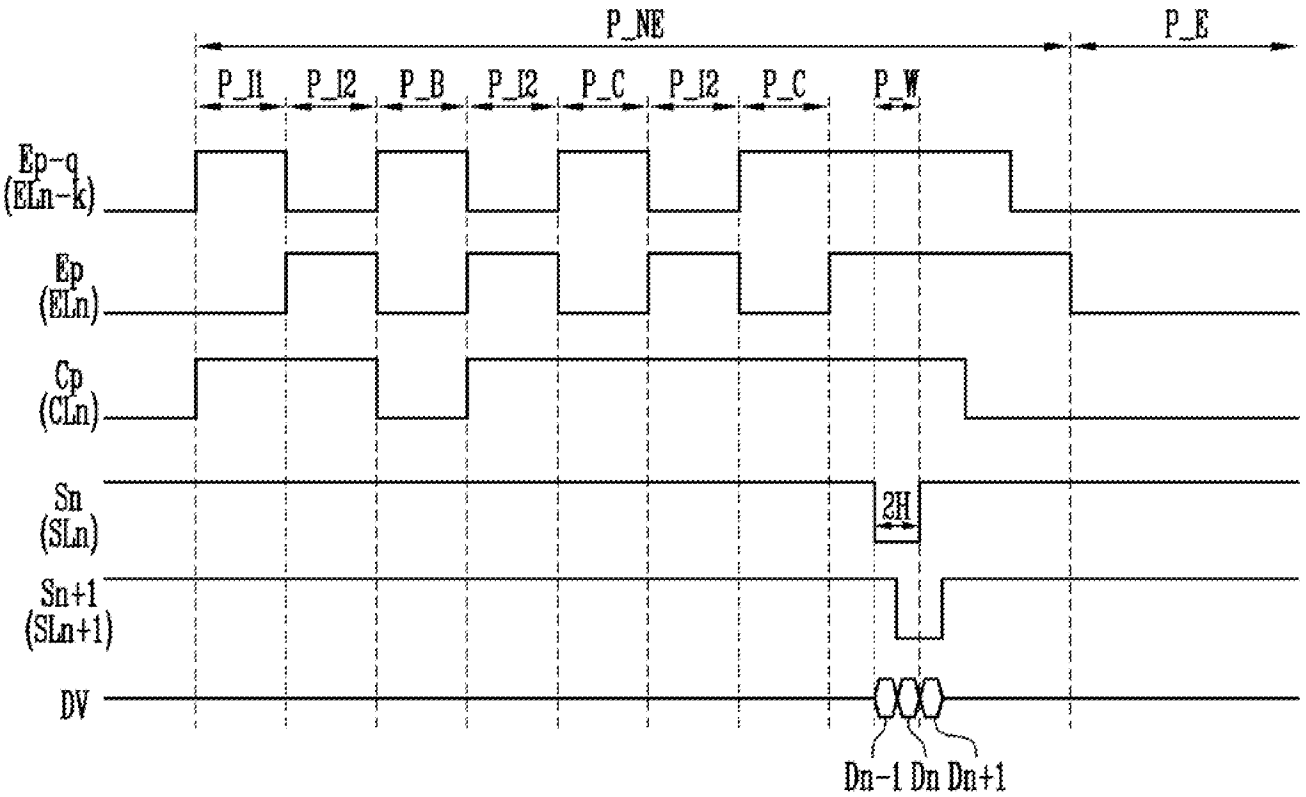
FIG. 9 is a timing diagram for describing an example of an operation of the pixel of FIG. 8.

FIG. 8 is a circuit diagram illustrating a pixel in accordance with an exemplary embodiment of the present invention. FIG. 9 is a timing diagram for describing an example of an operation of the pixel of FIG. 8.

The configuration and the operation of the pixel of FIG. 8, other than the configurations of the third and seventh transistors T3 and T7, are the same as those of the pixel of FIG. 2A. Therefore, like reference numerals may be used to designate components equal to or similar to those of FIG. 2A, and thus, a repetitive explanation may be omitted.

Referring to FIGS. 8 and 9, the pixel 11 may include a light emitting element LD, first to seventh transistors T1 to T7, a first capacitor C1, and a second capacitor C2.

In an exemplary embodiment of the present invention, each of the first, second, fifth, and, sixth transistors T1, T2, T5, and T6 may be a P-channel metal oxide semiconductor (PMOS) transistor, and each of the third and seventh transistors T3 and T7 may be an N-channel metal oxide semiconductor (NMOS) transistor. For example, the PMOS transistor may be an LTPS thin-film transistor, and the NMOS transistor may be an oxide semiconductor thin-film transistor. In other words, the NMOS transistor may include an active layer formed of an oxide semiconductor.

In this configuration, leakage current in the third and seventh transistors T3 and T7 may be significantly reduced. Therefore, during a driving operation with a low frequency of 30 Hz or less, an image flicker may be mitigated.

As illustrated in FIG. 9, the operation of the pixel 11 may be substantially the same as that of the pixel of FIG. 7B. In other words, since each of the third and seventh transistors T3 and T7 is an NMOS transistor, a control signal Cp of FIG. 8 may be a signal inverted with respect to the control signal Cp of FIG. 4. The gate-on level of the control signal Cp of FIG. 8 may be a high-level voltage.

Each frame may include an emission period P_E and a non-emission period P_NE. The non-emission period P_NE may include a first initialization period P_I1, a second initialization period P_I2, an on-bias period P_B, a compensation period P_C, and a write period P_W.

During the first initialization period P_I1, the anode voltage of the light emitting element LD may be initialized. The first initialization period P_I1 may correspond to the first period P1 of FIG. 5.

During the second initialization period P_I2, the anode voltage of the light emitting element LD and the gate voltage of the first transistor T1 may be initialized. The second initialization period P_I2 may correspond to the second, fourth, and sixth periods P2, P4, and P6 of FIGS. 5 and 6, During the second initialization period P_I2, the first transistor T1 may have an off-bias state.

During the on-bias period P_B, the first transistor T1 may have an on-bias state. The on-bias period P_B may correspond to the third period P3' of FIG. 6.

During the compensation period P_C, the threshold voltage of the first transistor T1 may be compensated for. The compensation period P_C may correspond to the fifth and seventh periods P5 and P7 of FIG. 6.

During the write period P_W, a data signal DV may be written to the pixel 11. The write period P_W may correspond to the eighth period P8 of FIG. 6.

During the emission period P_E, the light emitting element LD may emit light in response to the data signal DV. The emission period P_E may correspond to the ninth period P9 of FIG. 6.

Figure 10:
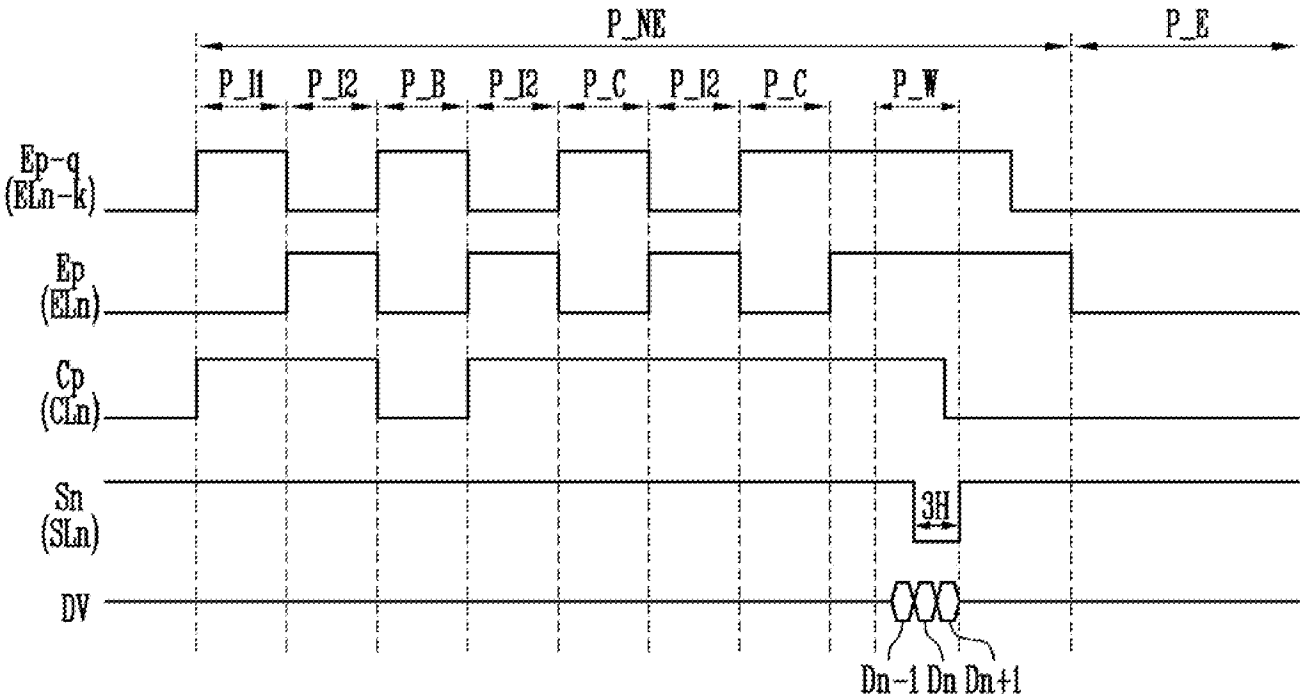
FIG. 10 is a timing diagram for describing an example of an operation of the pixel of FIG. 8.

FIG. 10 is a timing diagram for describing an example of an operation of the pixel of FIG. 8.

The operation of the pixel of FIG. 10, other than the voltage level of the control signal Cp and the length of the scan signal Sn during the write period P_W, is the same as that of the pixel a FIG. 9. Therefore, like reference numerals may be used to designate components equal to or similar to those of FIG. 9 and thus, a repetitive explanation may be omitted.

Referring to FIGS. 8 and 10, each frame may include an emission period P_E and a non-emission period P_NE. The non-emission period P_NE may include a first initialization period P_I1, a second initialization period P_I2, an on-bias period P_B, a compensation period P_C, and a write period P_W, as well as first and second initialization periods P_I1 and P_I2.

In an exemplary embodiment of the present invention, the scan signal Sn may have a length equal to or greater than three horizontal cycles 3H. However, this is only for illustrative purposes, and the length of the scan signal Sn is not limited thereto. For example, the scan signal Sn may be longer than three horizontal cycles 3H.

In an exemplary embodiment of the present invention, a gate-off period of the control signal Cp may overlap with a portion of a gate-on period of the scan signal Sn. The gate-off period of the control signal may be a period in which the control signal Cp has a gate-off level. The gate-on period of the scan signal Sn may be a period in which the scan signal Sn has a gate-on level. For example, during the write period P_W, the control signal Cp may transition from a gate-on level to the gate-off level.

Therefore, while the second transistor T2 is in a turned-on state, the third transistor T3 may be turned off. Consequently, the gate voltage of the first transistor T1 may not be changed after the data signal write operation.

Figure 11:
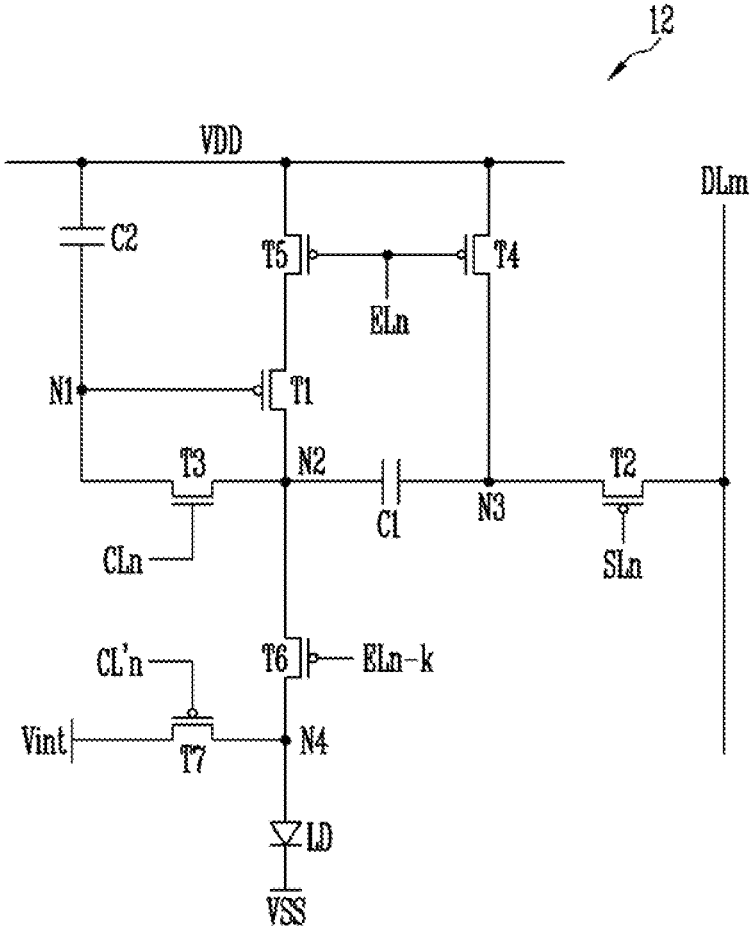
FIG. 11 is a circuit diagram illustrating a pixel in accordance with an exemplary embodiment of the present invention.

FIG. 11 is a circuit diagram illustrating a pixel in accordance with an exemplary embodiment of the present invention.

The configuration and the operation of the pixel of FIG. 11, other than the configuration of the seventh transistor T7, are the same as those of the pixel of FIG. 8. Therefore, like reference numerals may be used to designate components equal to or similar to those of FIG. 8, and thus, a repetitive explanation may be omitted.

Referring to FIG. 11, the pixel 12 may include a light emitting element LD, first to seventh transistors T1 to T7, a first capacitor C1, and a second capacitor C2.

In an exemplary embodiment of the present invention, each of the first, second, fourth, fifth, sixth, and seventh transistors T1, T2, T4, T5, T6, and T7 may be a PMOS transistor, and the third transistor T3 may be an NMOS transistor. For example, the PMOS transistor may be an LTPS thin-film transistor, and the NMOS transistor may be an oxide semiconductor thin-film transistor.

Different control lines CLn and CL'n may be coupled to the gate electrodes of the third transistor T3 and the seventh transistor T7. Control signals inverted with respect to each other may be respectively supplied to the control lines CLn and CL'n.

As described above, in the pixel 10, 11, or 12 and the display device 1000 including the pixel 10, 11, or 12 in accordance with an exemplary embodiment of the present invention, a threshold voltage compensation operation may be performed using the voltage of the first power supply VDD, and the threshold voltage compensation operation and the data write operation may be separately performed. Therefore, the threshold voltage compensation period may be easily adjusted. Furthermore, in the pixel 10, 11, or 12 and the display device 1000 including the pixel 10, 11, or 12 in accordance with an exemplary embodiment of the present invention, the initialization of a gate voltage (and an anode voltage) and the threshold voltage compensation operation are alternately and repeatedly performed during a non-emission period of each frame. Hence, a compensation deviation of the first transistor T1 due to a data signal of a preceding frame may be removed. Moreover, during a non-emission period, a period in which an off-bias is applied to the first transistor T1 and a period in which an on-bias is applied to the first transistor T1 are alternately repeated. Therefore, a threshold voltage deviation may be removed, and hysteresis characteristics of the first transistor T1 may be removed or improved.

Therefore, image failure (e.g., a flicker, a color-shifting phenomenon, or luminance degradation) in high-frequency driving with a driving frequency equal to or greater than 70 Hz) or low-frequency driving (e.g., with a driving frequency equal to or greater than 30 Hz) may be mitigated.

While the present invention has been described with reference to exemplary embodiments thereof, it will be understood by those of skill in the art that various changes in form and details may be made thereto without departing from the spirit and scope of the present invention as set forth in the following claims.

What is claimed is:

1. A pixel, comprising:

a light emitting element;

a first transistor including a first electrode electrically coupled to a first power supply, and a second electrode electrically coupled to the light emitting element, the first transistor configured to control a driving current;

a first capacitor coupled between a second node and a third node, wherein the second node is connected to the second electrode of the first transistor;

a second transistor coupled between the third node and a data line and configured to be turned on by a scan signal;

a third transistor coupled between a first node and the second node, and configured to be turned on by a control signal, wherein the first node is connected to a gate electrode of the first transistor;

a fourth transistor coupled between the first power supply and the third node, and configured to be turned on by a first emission control signal;

a fifth transistor coupled between the first power supply and the first electrode of the first transistor, and configured to be turned on by the first emission control signal;

a sixth transistor coupled between the second node and the light emitting element, and configured to be turned on by a second emission control signal; and a second capacitor coupled between the first power supply and the first node, wherein, during a non-emission period in a frame, each of the fourth, fifth and sixth transistors repeatedly performs a turn-on operation and a turn-off operation at least four times in response to the first emission control signal or the second emission control signal.

2. The pixel according to claim 1, wherein, during the non-emission period, each of the first emission control signal and the second emission control signal includes a plurality of gate-on periods and a plurality of gate-off periods.

3. The pixel according to claim 1, wherein the non-emission period includes an on-bias period in which each of the second emission control signal and the control signal has a gate-off level and the first emission control signal has a gate-on level.

4. The pixel according to claim 3, wherein, during the on-bias period, the third and sixth transistors are turned off, and the fourth and fifth transistors are turned on.

5. The pixel according to claim 1, wherein, when the third, fourth and fifth transistors are turned on, the second and sixth transistors are turned off.

6. The pixel according to claim 1, further comprising:

a seventh transistor coupled between the light emitting element and a initialization power supply and configured to be turned on by the control signal.

7. The pixel according to claim 6, wherein the non-emission period includes a first initialization period in which the initialization power supply is supplied to a fourth node between the light emitting element and the seventh transistor, a second initialization period in which the initialization power supply is supplied to the fourth node and the first node, an on-bias period in which the first transistor has an on-bias state, a compensation period in which the first transistor is diode-connected based on a voltage of the first power supply, and a write period in which the second transistor is turned on so that a data signal is supplied through the data line.

8. The pixel according to claim 7, wherein, in response to the control signal, the third transistor is turned on during the second initialization period, the compensation period, and the write period, and is turned off during the on-bias period.

9. The pixel according to claim 7 wherein, during the non-emission period, at least one of the second initialization-period the on-bias period, and the compensation period is repeated at least two times.

10. The pixel according to claim 9, wherein, during each of the first initialization period, the second initialization period, the on-bias period, and the compensation period, a switching operation of each of the fourth and fifth transistors is performed in reverse to a switching operation of the sixth transistor.

11. The pixel according to claim 9, wherein, during the second initialization period, the third, sixth, and seventh transistors are turned on and the fourth and fifth transistors are turned off, so that the first transistor has an off-bias state.

12. The pixel according to claim 9, wherein, during the compensation period, the third, fourth and fifth transistors are tuned on and the second and sixth transistors are turned off, and wherein, during the write period, the second and third transistors are turned on, and the fourth, fifth and sixth transistors are turned off.

13. The pixel according to claim 7, wherein a length of the compensation period is greater that a length of the write period.

14. The pixel according to claim 7, wherein, during the write period, a gate-off period of the control signal overlaps with a portion of a gate-on period of the scan signal, and wherein, while the second transistor remains turned on during the write period, the third transistor is turned off.

15. The pixel according to claim 7, wherein the first emission control signal is obtained by shifting the second emission control signal by k horizontal cycles, wherein k is an integral number greater than or equal to 3.

16. A display device, comprising:

a display panel including a plurality of pixels;

a first scan driver configured to supply a scan signal to the pixels through a plurality of scan lines;

a second scan driver configured to supply a control signal to the pixels through a plurality of control lines;

an emission driver configured to supply an emission control signal to the pixels through a plurality of emission control lines; and a data driver configured to supply a data voltage to the display panel through a plurality of data lines, wherein each of the pixels comprises:

a light emitting element;

a first transistor including a first electrode electrically coupled to a first power supply, and a second electrode electrically coupled to the light emitting element, the first transistor configured to control a driving current;

a first capacitor coupled between a second node and a third node, wherein the second node is connected to the second electrode of the first transistor;

a second transistor coupled between the third node and a corresponding one of the data lines and configured to be turned on by the scan signal;

a third transistor coupled between a first node and the second node and configured to be turned on by the control signal, wherein the first node is connected to a gate electrode of the first transistor;

a fourth transistor coupled between the first power supply and the third node, and configured to be turned on by the emission control signal;

a fifth transistor coupled between the first power supply and the first electrode of the first transistor, and configured to be turned on by the emission control signal;

a sixth transistor coupled between the second node and the light emitting element, and configured to be turned on by a preceding emission control signal;

a seventh transistor coupled between the light emitting element and an initialization power supply, and configured to be turned on by the control signal; and a second capacitor coupled between the first power supply and the first node, wherein, during a non-emission period in a frame, each of the fourth, fifth and sixth transistors repeatedly performs a turn-on operation and a turn-off operation at least four times.

17. The display device according to claim 16, wherein the non-emission period includes an on-bias period in Which each of the preceding emission control signal and the control signal has a gate-off level and the emission control signal has a gate-on level, and wherein, during the on-bias period, the third and sixth transistors are turned off, and the fourth and fifth transistors are turned on.

18. The display device according to claim 16, wherein the emission driver simultaneously supplies the emission control signal to the fourth and fifth transistors of an n-th pixel disposed on an n-th pixel row and to the fourth and fifth transistors of an n+1-th pixel disposed on an n+1-th pixel row.

19. The display device according to claim 18, wherein the second scan driver simultaneously supplies the control signal to the third and seventh transistors of the n-th pixel and to the third and seventh transistors of the n+1-th pixel.

20. The display device according to claim 16, wherein the non-emission period includes an off bias period in which each of the preceding emission control signal and the control signal has a gate-on level and the emission control signal has a gate-off level, and wherein, during the off-bias period, the third and sixth transistors are turned on, the fourth and fifth transistors are turned on, and the first transistor has an off-bias state.

21. A pixel, comprising:

a light emitting element;

a first transistor including a first electrode electrically coupled to a first power supply, and a second electrode electrically coupled to the light emitting element, the first transistor configured to control a driving current;

a first capacitor coupled to the second electrode of the first transistor;

a second transistor coupled between a data line and the first capacitor and configured to be turned on by a scan signal;

a third transistor coupled between a gate electrode of the first transistor and the second electrode of the first transistor;

a fourth transistor coupled between the first power supply and the first capacitor, and configured to be turned on by a first emission control signal;

a fifth transistor coupled between the first power supply and the first electrode of the first transistor, and configured to be turned on by the first emission control signal;

a sixth transistor coupled between the second electrode of the first transistor and the light emitting element, and configured to be turned on by a second emission control signal; and a second capacitor coupled between the first power supply and the gate electrode of the first transistor, wherein, during a non-emission period in a frame, each of the fourth, fifth and sixth transistors repeatedly performs a tuna-on operation and a turn-off operation at least four times in response to the first emission control signal or the second emission control signal.

* * * * *